US011034915B2

(12) United States Patent
Mathews et al.

(10) Patent No.: US 11,034,915 B2
(45) Date of Patent: Jun. 15, 2021

(54) CLEANING COMPOSITIONS AND METHODS FOR CLEANING ENGINE COOLING SYSTEMS

(71) Applicant: PRESTONE PRODUCTS CORPORATION, Danbury, CT (US)

(72) Inventors: Joseph K. Mathews, New Milford, CT (US); David L. Balog, Danbury, CT (US); Thomas G. Kalagher, Torrington, CT (US); Peter M. Woyciesjes, Woodbury, CT (US)

(73) Assignee: PRESTONE PRODUCTS CORPORATION, Danbury, CT (US)

( * ) Notice: Subject to any disclaimer, the term of this patent is extended or adjusted under 35 U.S.C. 154(b) by 1 day.

(21) Appl. No.: 15/875,563

(22) Filed: Jan. 19, 2018

(65) Prior Publication Data

US 2018/0208877 A1 Jul. 26, 2018

Related U.S. Application Data

(60) Provisional application No. 62/448,742, filed on Jan. 20, 2017.

(51) Int. Cl.
*C11D 1/72* (2006.01)
*C11D 3/36* (2006.01)
(Continued)

(52) U.S. Cl.
CPC ..... *C11D 1/72* (2013.01); *C11D 3/0073* (2013.01); *C11D 3/044* (2013.01); *C11D 3/2082* (2013.01); *C11D 3/2086* (2013.01); *C11D 3/361* (2013.01); *C11D 3/362* (2013.01); *C11D 11/0041* (2013.01); *F01P 11/06* (2013.01); *F28F 19/00* (2013.01); *F28G 9/00* (2013.01); *F28D 2021/0094* (2013.01); *F28F 19/01* (2013.01)

(58) Field of Classification Search
CPC ..... C11D 1/72; C11D 3/044; C11D 3/2068; C11D 3/36; C11D 3/43; C11D 7/36
See application file for complete search history.

(56) References Cited

U.S. PATENT DOCUMENTS 4,284,532 A 8/1981 Leikhim et al.
4,540,443 A 9/1985 Barber
(Continued)

FOREIGN PATENT DOCUMENTS

CN 103756804 4/2014
EP 0028038 5/1981

OTHER PUBLICATIONS

"North America Phosphate Esters Market" (Apr. 2016) retrieved Apr. 20, 2018 from http://www.micromarketmonitor.com/market/north-america-phosphate-esters-9779109677.html.
(Continued)

*Primary Examiner* — Brian P Mruk
(74) *Attorney, Agent, or Firm* — Barnes & Thornburg LLP; Gregory H. Zayia

(57) ABSTRACT

Cleaning compositions include (a) a carrier liquid; (b) a metal citrate and/or a plurality of reagents configured to generate the metal citrate in situ; (c) one or a plurality of non-ionic surfactants; and (d) an organophosphate hydrotrope configured to increase solubility of the one or the plurality of non-ionic surfactants in the carrier liquid. Methods for cleaning engine cooling systems are described.

23 Claims, 3 Drawing Sheets

(51) Int. Cl.

| | |
|---|---|
| ***C11D 3/43*** | (2006.01) |
| ***C11D 7/36*** | (2006.01) |
| ***C11D 11/00*** | (2006.01) |
| ***C11D 3/04*** | (2006.01) |
| ***F28G 9/00*** | (2006.01) |
| ***C11D 3/20*** | (2006.01) |
| ***C11D 3/00*** | (2006.01) |
| ***F28F 19/00*** | (2006.01) |
| ***F01P 11/06*** | (2006.01) |
| *F28D 21/00* | (2006.01) |
| *F28F 19/01* | (2006.01) |

(56) References Cited

U.S. PATENT DOCUMENTS

| | | | | |
|---|---|---|---|---|
| 2005/0245411 | A1 | 11/2005 | Yang et al. | |
| 2006/0112972 | A1 | 6/2006 | Peitersen et al. | |
| 2007/0259802 | A1 | 11/2007 | Heintz et al. | |
| 2010/0184855 | A1 | 7/2010 | Bernhardt et al. | |
| 2010/0317559 | A1* | 12/2010 | Ryther | C11D 3/044 510/218 |
| 2011/0000505 | A1* | 1/2011 | Yang | C11D 7/266 134/2 |

OTHER PUBLICATIONS

Hannan, "Technician's Formulation Handbook for Industrial and Household Cleaning Products", Hannan Kyral LLC, ISBN 978-0615156019, (Aug. 19, 2007).

International Search Report and Written Opinion of Application No. PCT/US2018/14452, dated May 9, 2018.

Office Action issued in Appl. No. CN 201880019476.6 (Sep. 14, 2020).

Anonymous, "phosphate esters," Lakeland Laboratories Limited, pp. 1-12, Retrieved from the Internet: URL:https://web.archive.org/web/20190711102613/https://surchem.pl/pl/ kosmetyki/pdf/Lieferprogramm_Phosphate%20Esters.pdf (Jul. 11, 2019).

Extended Search Report issued in Appl. No. EP 18742219.1 (dated Apr. 21, 2021).

* cited by examiner

CLEANING COMPOSITIONS AND METHODS FOR CLEANING ENGINE COOLING SYSTEMS

RELATED APPLICATIONS

This application claims the benefit of U.S. Provisional Application No. 62/448,742, filed Jan. 20, 2017. The entire contents of the Provisional Application are incorporated herein by reference.

TECHNICAL FIELD

The present teachings relate generally to cleaning compositions for engine cooling systems, and to methods for using cleaning compositions to remove engine coolant contaminants from heat exchange systems. In some embodiments, the present teachings relate to cleaning compositions for flushing and degreasing engine cooling systems (e.g., including but not limited to engine cooling systems containing one or more aluminum surfaces) to remove corrosion by-products as well as hydrocarbons (e.g., oil, grease, fuel, etc.).

BACKGROUND

Vehicle manufacturers generally recommend that a vehicle's antifreeze be changed periodically in order to prevent accumulation of corrosion by-products (e.g., rust, metal oxides, etc.) in the engine's cooling system. The recommended frequency of change may depend on the engine make and the type of antifreeze used. For example, the antifreeze in the cooling system of a light-duty (LD) vehicle may be changed every three to five years or every 60,000 to 150,000 miles. The antifreeze in the cooling system of a heavy-duty (HD) vehicle may be changed every three to five years or every 100,000 to 700,000 miles. Changing a vehicle's antifreeze within the manufacturer's recommended intervals may help prevent accumulation of corrosion by-products that have a tendency to form as the corrosion inhibitors in an antifreeze break down and are no longer able to protect the metal surfaces of the cooling system.

Corrosion by-products may reduce the efficiency of an engine cooling system by interfering with the flow of coolant through the air/liquid heat exchanging fin-tubes of the radiator core and by coating the heat exchangers. The abrasive nature of the suspended corrosive materials may also increase the wear and tear on the water pump, hoses, thermostat, and/or heater core. Malfunction of cooling system components is a significant cause of vehicular breakdown. Once a cooling system malfunctions and over-heats, the seals used to separate the lubrication system from the cooling system may fail due to warping of the metals. The leaks that develop may allow fluids from the two systems to mix, eventually leading to the failure of one or both systems.

Thus, engine performance and engine life may be affected by the efficacy of the engine cooling system. However, based on presently available technology, two types of engine cooling system flushes are generally needed to adequately clean the passageways found in an engine cooling system. One flush is needed to remove corrosion by-products, such as silicates and metal oxides, while a different flush is needed to remove oil contamination. At present, there is no commercially available dual purpose flush and degreaser cleaning composition.

SUMMARY

The scope of the present invention is defined solely by the appended claims, and is not affected to any degree by the statements within this summary.

By way of introduction, a first cleaning composition configured to remove a corrosion by-product and/or hydrocarbon contamination from an engine cooling system in accordance with the present teachings includes (a) a carrier liquid; (b) a metal citrate and/or a plurality of reagents configured to generate the metal citrate in situ; (c) one or a plurality of non-ionic surfactants; and (d) an organophosphate hydrotrope configured to increase solubility of the one or the plurality of non-ionic surfactants in the carrier liquid.

A second cleaning composition configured to remove a corrosion by-product and/or hydrocarbon contamination from an engine cooling system in accordance with the present teachings includes (a) water in an amount ranging from about 60 wt. % to about 80 wt. % based on a total weight of the cleaning composition; (b) citric acid in an amount ranging from about 8 wt. % to about 12 wt. % based on the total weight of the cleaning composition; (c) an alkali metal hydroxide in an amount ranging from about 4 wt. % to about 8 wt. % based on the total weight of the cleaning composition; (d) a first lauryl alcohol ethoxylate surfactant having an HLB of greater than about 10.0 and a second lauryl alcohol ethoxylate surfactant having an HLB of less than about 10.0, wherein the first lauryl alcohol ethoxylate surfactant and the second lauryl alcohol ethoxylate surfactant are present in a combined amount ranging from about 4 wt. to about 6 wt. % based on the total weight of the cleaning composition; and (e) an aromatic phosphate ester salt in an amount ranging from about 5 wt. % to about 7 wt. % based on the total weight of the cleaning composition.

A third cleaning composition configured to remove a corrosion by-product and/or hydrocarbon contamination from an engine cooling system in accordance with the present teachings is prepared by a process that includes combining water, citric acid, an alkali metal hydroxide, one or a plurality of $C_{12}$-$C_{15}$ non-ionic surfactants, and an organophosphate hydrotrope to form a solution having a pH of between about 9.0 and about 10.0.

A method of cleaning an engine cooling system in accordance with the present teachings includes contacting at least a portion of the engine cooling system with a cleaning composition of a type described above.

DETAILED DESCRIPTION

Figure 1:
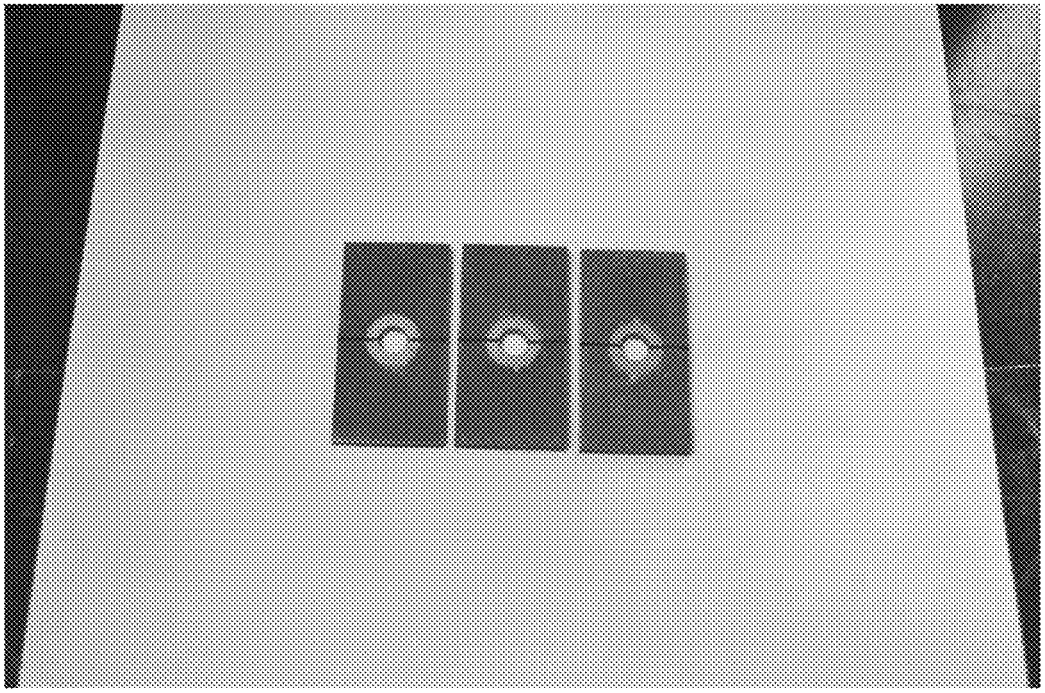
FIG. 1 shows a photograph of corroded aluminum samples before cleaning.

Cleaning compositions with the capacity to remove both corrosion by-products as well as hydrocarbon contamination (e.g., oil, fuel, diesel, grease, etc.) from an engine cooling system during the same system flush have been discovered and are described herein. In stark contrast to conventional methodology which requires one system flush to remove corrosion by-products (e.g., silicates, metal oxides, and/or the like), and a different system flush to remove hydrocarbons (e.g., oil, fuel, grease, and/or the like), the cleaning compositions in accordance with the present teachings may be employed to perform both flush and degreasing in the same system flush.

In addition, cleaning compositions in accordance with the present teachings may be used to clean an engine cooling system even if some leftover used coolant remains in the system. As such, cleaning compositions in accordance with the present teachings may be simpler to use as compared to conventional technology. For example, when the cooling systems of LD and HD engines are drained, a percentage of fluid often remains within the system. In some cases, as much as 30-60 wt. % of used antifreeze may remain inside the cooling system of an engine after draining. As a result, in conventional technology, thorough removal of the old antifreeze prior to cleaning is usually recommended in order to prevent compatibility issues with the materials of the cooling system. In stark contrast to the conventional technology in which complete removal is advisable, there is greater flexibility associated with the use of cleaning compositions in accordance with the present teachings.

It is to be understood that elements and features of the various representative embodiments described below may be combined in different ways to produce new embodiments that likewise fall within the scope of the present teachings.

By way of general introduction, a cleaning composition configured to remove a corrosion by-product and/or hydrocarbon contamination from an engine cooling system in accordance with the present teachings includes (a) a carrier liquid; (b) a metal citrate and/or a plurality of reagents configured to generate the metal citrate in situ; (c) one or a plurality of non-ionic surfactants; and (d) an organophosphate hydrotrope configured to increase solubility of the one or the plurality of non-ionic surfactants in the carrier liquid.

As used herein, the phrase "hydrocarbon contamination" refers to all manner of organic materials to be removed from an engine cooling system. By way of example, representative "hydrocarbon contamination" includes but is not limited to grease, oil, fuel, diesel, and/or the like, and combinations thereof.

As used herein, references to weight percent (wt. %) of a particular component in a cleaning composition formulation are calculated based on a 1:16 treatment ratio. It is to be understood that increasing or decreasing the amount of carrier fluid in a cleaning composition in accordance with the present teachings may impact the weight percent of a given component in the composition but will not change the active amount (e.g., number of grams) of that component being introduced into an engine cooling system. As such, changes in the amount of carrier fluid may not substantially impact the efficacy of the cleaning composition.

In addition, it is to be understood that cleaning compositions in accordance with the present teachings may be used in HD engines, LD engines, and/or mid-duty (MD) engines. While the cleaning composition formulation itself may remain unchanged, the amount of the cleaning composition to be added to the respective cooling systems may be varied. For example, in HD engines, the treat rate is up to 16 gallons. Thus, one gallon of cleaning composition in accordance with the present teachings may be added to a 16-gallon cooling system of the HD vehicle. Likewise, in LD or MD engines, the treat rate is up to 16 quarts. Thus, one quart of cleaning composition in accordance with the present teachings may be added to a 16-quart cooling system of the LD or MD vehicle.

Cleaning compositions in accordance with the present teachings include a carrier liquid which, in some embodiments, includes water. The type of water used in accordance with the present teachings is not restricted. However, in some embodiments, the water used in a cleaning composition in accordance with the present teachings includes de-ionized water, demineralized water, softened water, or a combination thereof. In some embodiments, a hardness of the water due to $CaCO_3$ is less than about 20 ppm. In other embodiments, an electrical conductivity of the water is less than about 300 μS/cm. In further embodiments, a hardness of the water due to $CaCO_3$ is less than about 20 ppm and an electrical conductivity of the water is less than about 300 μS/cm. The amount of water may vary depending on the application. By way of example, the concentration of the water may range from about 50 wt. % to about 90 wt. % based on the total weight of the cleaning composition, in some embodiments from about 55 wt. % to about 85 wt. %, in some embodiments, from about 60 wt. % to about 80 wt. %, and in some embodiments may be about 70 wt. %.

Cleaning compositions in accordance with the present teachings include a metal citrate and/or a plurality of reagents configured to generate the metal citrate in situ. In some embodiments, the metal is an alkali metal and, in other embodiments, the metal is an alkaline earth metal. In some embodiments, the metal is sodium. In accordance with the present teachings, a metal citrate (e.g., sodium citrate) may be used as a chelating agent to sequester metal cations, such as may be found in a corrosion by-product. By way of example, in some embodiments (e.g., when the engine cooling system includes an aluminum surface), a metal citrate (e.g., sodium citrate) may be used as a chelating agent to sequester aluminum cations. Aluminum oxide is an amphoteric species, which means that it can react with either an acid or a base, and aluminum oxide is one of the most common corrosion by-products in aluminum-containing engine cooling systems.

In some embodiments, cleaning compositions in accordance with the present teachings include a plurality of reagents configured to generate an alkali metal citrate (e.g., sodium citrate) in situ. For example, in some embodiments, the plurality of reagents may include citric acid and a base. In some embodiments, the base is an alkali metal hydroxide, such as sodium hydroxide. The amount of citric acid and the amount of alkali metal hydroxide may vary depending on the application. By way of example, the concentration of the citric acid may range from about 8 wt. % to about 12 wt. % based on the total weight of the cleaning composition, in some embodiments from about 9 wt. % to about 11 wt. %, and in some embodiments may be about 10 wt. %. In addition, in some embodiments, the concentrate of alkali metal hydroxide (e.g., sodium hydroxide) may range from about 4 wt. % to about 8 wt. % based on the total weight of the cleaning composition, in some embodiments from about 5 wt. % to about 7 wt. %, and in some embodiments may be about 6.5 wt. %.

In alternative embodiments, oxalic acid and/or an oxalate may be used in place of a metal citrate in a cleaning composition in accordance with the present teachings.

The pH of a cleaning composition in accordance with the present teachings may be alkaline (e.g., greater than 7.0). In some embodiments, the pH of a cleaning composition in accordance with the present teachings ranges from about 7.5 to about 11.5, in some embodiments from about 8.0 to about 11.0, in some embodiments from about 8.5 to about 10.5, in some embodiments from about 9.0 to about 10.0, and in some embodiments may be about 9.5. Citric Acid which, in some embodiments, may be neutralized with sodium hydroxide to a pH of about 8.5, may help to slow the corrosion rate of aluminum within an engine cooling system.

Cleaning compositions in accordance with the present teachings include one or a plurality of non-ionic surfactants. Representative non-ionic surfactants suitable for use in a cleaning composition in accordance with the present teachings include but are not limited to fatty acid esters, such as sorbitan fatty acid esters, polyalkylene glycols, polyalkylene glycol esters, copolymers of ethylene oxide (EO) and propylene oxide (PO), polyoxyalkylene derivatives of a sorbitan fatty acid ester, and/or the like, and combinations thereof. In some embodiments, the average molecular weight of the non-ionic surfactants is between about 55 and about 300,000 and, in some embodiments, between about 110 and about 10,000. Representative sorbitan fatty acid esters include but are not limited to sorbitan monolaurate (e.g., sold under the tradename Span® 20, Arlacel® 20, S-MAZ® 20M1), sorbitan monopalmitate (e.g., Span® 40 or Arlacel® 40), sorbitan monostearate (e.g., Span® 60, Arlacel® 60, or S-MAZ® 60K), sorbitan monooleate (e.g., Span® 80 or Arlacel® 80), sorbitan monosesquioleate (e.g., Span® 83 or Arlacel® 83), sorbitan trioleate (e.g., Span® 85 or Arlacel® 85), sorbitan tridtearate (e.g., 5-MAZ® 65K), and sorbitan monotallate (e.g., S-MAZ® 90). Representative polyalkylene glycols include but are not limited to polyethylene glycols, polypropylene glycols, and combinations thereof. Representative polyethylene glycols include but are not limited to CARBOWAX™ polyethylene glycols and methoxypolyethylene glycols from Dow Chemical Company (e.g., CARBOWAX PEG 200, 300, 400, 600, 900, 1000, 1450, 3350, 4000 & 8000, etc.) or PLURACOL® polyethylene glycols from BASF Corp. (e.g., Pluracol® E 200, 300, 400, 600, 1000, 2000, 3350, 4000, 6000 and 8000, etc.). Representative polyalkylene glycol esters include but are not limited to mono- and di-esters of various fatty acids, such as MAPEG® polyethylene glycol esters from BASF (e.g., MAPEG® 200ML or PEG 200 Monolaurate, MAPEG® 400 DO or PEG 400 Dioleate, MAPEG® 400 MO or PEG 400 Monooleate, and MAPEG® 600 DO or PEG 600 Dioleate, etc.). Representative copolymers of ethylene oxide (EO) and propylene oxide (PO) include but are not limited to various Pluronic and Pluronic R block copolymer surfactants from BASF, DOWFAX non-ionic surfactants, UCON™ fluids and SYNALOX lubricants from DOW Chemical. Representative polyoxyalkylene derivatives of a sorbitan fatty acid ester include but are not limited to polyoxyethylene 20 sorbitan monolaurate (e.g., products sold under the tradenames TWEEN 20 or T-MAZ 20), polyoxyethylene 4 sorbitan monolaurate (e.g., TWEEN 21), polyoxyethylene 20 sorbitan monopalmitate (e.g., TWEEN 40), polyoxyethylene 20 sorbitant monostearate (e.g., TWEEN 60 or T-MAZ 60K), polyoxyethylene 20 sorbitan monooleate (e.g., TWEEN 80 or T-MAZ 80), polyoxyethylene 20 tristearate (e.g., TWEEN 65 or T-MAZ 65K), polyoxyethylene 5 sorbitan monooleate (e.g., TWEEN 81 or T-MAZ 81), polyoxyethylene 20 sorbitan trioleate (e.g., TWEEN 85 or T-MAZ 85K), and/or the like, and combinations thereof.

In some embodiments, the non-ionic surfactants used in accordance with the present teachings include one or a plurality of $C_{12}$-$C_{15}$ non-ionic surfactants. In some embodiments, the $C_{12}$-$C_{15}$ non-ionic surfactants include one or a plurality of $C_{12}$-$C_{15}$ fatty alcohol polyglycol ethers. Representative $C_{12}$-$C_{15}$ fatty alcohol polyglycol ethers for use in accordance with the present teachings include but are not limited to lauryl alcohol ethoxylates. The amount of the non-ionic surfactant (or the combined amount of the plurality of non-ionic surfactants) may vary depending on the application. By way of example, the total amount of one or a plurality of non-ionic surfactants present in a cleaning composition in accordance with the present teachings may range from about 3.0 wt. % to about 7.0 wt. % based on the total weight of the cleaning composition, in some embodiments from about 4.0 wt. % to about 6 wt. %, and in some embodiments may be about 5.0 wt. %.

In addition, the hydrophile-lipophile balance (HLB) of the one or the plurality of non-ionic surfactant useds in a cleaning composition in accordance with the present teachings may likewise vary depending on the application. For example, in some embodiments, each of the one or the plurality of non-ionic surfactants may have an HLB ranging from about 7.0 to about 14.0, in some embodiments from about 7.5 to about 13.0, and in some embodiments from about 8.0 to about 12.5. In some embodiments, a cleaning composition in accordance with the present teachings includes at least a first non-ionic surfactant having an HLB of greater than about 10.0 and at least a second non-ionic surfactant having an HLB of less than about 10.0. In other embodiments, a cleaning composition in accordance with the present teachings includes a first lauryl alcohol ethoxylate having an HLB of about 12.4 (e.g., the nonionic surfactant sold under the tradename GENAPOL LA 070 S by Clariant International Ltd.) and a second lauryl alcohol ethyoxylate having an HLB of about 8.0 (e.g., the nonionic surfactant sold under the tradename GENAPOL LA 030 by Clariant International Ltd.).

While neither desiring to be bound by any particular theory nor intending to limit in any measure the scope of the appended claims or their equivalents, it is presently believed that the best detergency and cleaning of a particular surfactant may be achieved when the cloud point of the surfactant is just above or below the temperature of the system in which the surfactant is being used. Automotive heat exchanger system temperatures typically range from about 190° F. to about 210° F. For such a system, a surfactant with a cloud point of about 195° F. may be used. However, as noted above, complete removal of old antifreeze (e.g., ethylene glycol) from an engine cooling system via the draining procedure may not always be possible prior to the introduction of a cleaning composition into the cooling system. Moreover, since ethylene glycol will lower the cloud point of the first surfactant, an additional surfactant that utilizes the same cleaning characteristics as the first surfactant but which has a higher cloud point (e.g., about 260° F.) may be added. When used with the heal of ethylene glycol commonly found in LD and HD systems, the cloud point will drop to the desired coolant temperature of about 195° F., thus resulting in better cleaning and detergency.

In some embodiments, a first non-ionic surfactant used as an oil-in-water emulsifier (e.g., GENAPOL LA 070 S) and a second non-ionic surfactant used as a rheology surfactant (e.g., GENAPOL LA 030) may be coupled in the solution of a cleaning composition in accordance with the present teachings. When the pair of non-ionic surfactants is used in conjunction with citric acid and sodium hydroxide, a hydrotrope may be needed to increase the solubility of the first and second surfactants and to achieve optimum formulation stability. The resulting formulation may be stable over a wide range of temperatures with exceptional cleaning performance for oil-in-water contaminates.

Cleaning compositions in accordance with the present teachings include an organophosphate hydrotrope configured to increase the solubility of the one or the plurality of non-ionic surfactants in the carrier liquid (e.g., water), thus increasing formulation stability. Representative organophosphates for use in accordance with the present teachings include but are not limited to aromatic phosphate ester salts (e.g., the aromatic phosphate ester potassium salt sold under the tradename DEPHOS H-66-872 by DeForest Enterprises, Inc.). Additional representative organophosphates for use in accordance with the present teachings include but are not limited to ethylene glycol phosphate; 1,2,3-propanetriol phosphate (CAS #: 12040-65-2); a phosphate polyether ester; a $C_6$-$C_{12}$ alkyl alcohol ethoxylate phosphoric acid (CAS #: 68921-24-4); an alkali metal salt of phosphate ester of cresyl ethoxylate (CAS #: 66057-30-5); potassium cresyl phosphate (CAS #: 37281-48-4); octylphenoxypolyethoxyethyl phosphate; octylphenoxy polyethyl phosphate; olyethylene glycol mono(octylphenyl) ether phosphate; alkali metal salts of alkylphenoxypolyethoxyethyl phosphoric acid having a formula R-phenyl$(CH_2CH_2O)_x$phosphate in which R is hydrogen or $C_1$-$C_{20}$ alkyl (in some embodiments, $C_1$-$C_{12}$) and x equals 1 to 30 (in some embodiments, 2 to 10); alkyl or aryl acid phosphates, such as isooctyl acid phosphate, 2-ethylhexyl acid phosphate, amyl acid phosphate, amyl dihydrogen phosphate, diamyl hydrogen phosphate, butyl acid phosphate, and/or the like; and combinations thereof.

The amount of organophosphate hydrotrope may vary depending on the application. By way of example, the concentration of the organophosphate hydrotrope may range from about 4.0 wt. % to about 8 wt. % based on the total weight of the cleaning composition, in some embodiments from about 5.0 wt. % to about 7 wt. %, and in some embodiments, may be about 6.0 wt. %.

In some embodiments, a cleaning composition in accordance with the present teachings optionally further includes one or a plurality of additional components selected from the group consisting of a glycol ether coupling agent, a biocide agent, an antifoam agent, a dye, and combination thereof.

In some embodiments, a cleaning composition in accordance with the present teachings further includes a glycol ether coupling agent which, in some embodiments, is butyl carbitol. The amount of the optional coupling agent may vary depending on the application. By way of example, in some embodiments, the concentration of the glycol ether coupling agent ranges from about 1.0 wt. % to about 3.0 wt. % based on the total weight of the cleaning composition and, in some embodiments may be about 2.0 wt. %.

In some embodiments, a cleaning composition in accordance with the present teachings further includes an additional component selected from the group consisting of a biocide agent, an antifoam agent, a dye, and a combination thereof. The amount of the optional additional component may vary depending on the application. By way of example, in some embodiments, the combined amount of the biocide agent, the antifoam agent, and the dye ranges from about 0.10 wt. % to about 0.50 wt. % based on the total weight of the cleaning composition and, in some embodiments, may be about 0.30 wt. %.

Representative biocides suitable for use in a cleaning composition in accordance with the present teachings include but are not limited to various non-oxidizing biocides, such as glutaraldehyde, isothiazolin, 5-chloro-2-methyl-4-isothiazolin-3-one, 2-methyl-4-isothiazolin-3-one, 1,2-benzisothiazolin-3-one, 2,2-dibromo-3-nitrilopropionamide, 2-bromo-2-nitropropane-1,3-diol, methylene bis(thiocyanate), terbuthylazine, tetrakis(hydroxymethyl)phosphonium sulphate, and/or the like, and combinations thereof.

Any suitable antifoaming agent or defoamer, including but not limited to conventionally known such agents, may be used in cleaning compositions in accordance with the present teachings. While neither desiring to be bound by any particular theory nor intending to limit in any measure the scope of the appended claims or their equivalents, it is presently believed that the use of an antifoam agent in a cleaning composition in accordance with the present teachings allows the composition to be used in a vehicle without resulting in foaming. Thus, the antifoam agent does not merely provide antifoaming protection during filling of the container but may also provide protection during usage as well.

Representative defoamers that may be used in a cleaning composition in accordance with the present teachings include but are not limited to an organo-modified polydimethylsiloxane-containing polyalkylene glycol, siloxane polyalkylene oxide copolymer, polyalkylene oxide, "PM-5150" available from Prestone Products Corp., "Pluronic L-61" and "Plurafac® LF 224" from BASF Corp., "Patcote 492", "Patcote 415" and other Patcote-branded antifoam available from Hydrite Chemical Co. and other suppliers, and "Foam Ban 136B" and other Foam Ban antifoams available from Munzing Chemie GmbH or affiliated companies. The optional antifoam agents may also include polydimethylsiloxane emulsion-based antifoams, including but not limited to PC-5450NF from Performance Chemicals, LLC in Boscawen, N.H.; and CNC antifoam XD-55 NF and XD-56 from CNC International in Woonsocket in RI. In some embodiments, the optional antifoam agents may include a silicone or organo-modified polydimethylsiloxane, for example, SAG brand of silicone-based antifoams (e.g., SAG-10, Silbreak® 320) from OSI Specialties Inc., Momentive Performance Materials Inc. in Waterford, N.Y., Dow Corning and other suppliers; an ethylene oxide-propylene oxide (EO-PO) block copolymer and a propylene oxide-ethylene oxide-propylene oxide (PO-EO-PO) block copolymer (e.g., Pluronic L61, Pluronic L81, and other Pluronic and Pluronic C products); poly(ethylene oxide) or poly(propylene oxide), for example, PPG 2000 (e.g., polypropylene oxide with an average molecular weight of 2000 Daltons); polydiorganosiloxane-based products (e.g., products containing polydimethylsiloxane (PDMS), and the like); fatty acids or fatty acid esters (e.g., stearic acid, and the like); a fatty alcohol, an alkoxylated alcohol and a polyglycol; a polyether polyol acetate, a polyether ethoxylated sorbital hexaoleate, and a poly(ethylene oxide-propylene oxide)monoallyl ether acetate; a wax, a naphtha, kerosene, and an aromatic oil; and/or the like; and combinations thereof.

As noted above, colorants or dyes are optional components and, in some embodiments, a cleaning composition in accordance with the present teachings does not include a colorant or dye. Representative colorants or dyes suitable for use in a cleaning composition in accordance with the present teachings include but are not limited to "Uranine Yellow," "Uranine Dye," "Alizarine Green," "Chromatint Orange 1735" or "Green AGS liquid" from Abbeys Color Inc., or Chromatech Incorporated, "Chromatint Yellow 0963 Liquid Dye," "Chromatint Yellow 2741 Liquid Dye," "Chromatint Green 1572 dye," "Chromatint Green 2384 Dye," "Chromatint Violet 1579 Dye" from Chromatech Incorporated, "Acid Red #52" or Sulforhodamine B from Tokyo Chemical Industry Co. or TCI America, "Orange II (acid Orange 7)"

or "Intracid Rhodamine WT (Acid Red 388)" from Sensient Technologies or other suppliers.

A method of cleaning an engine cooling system in accordance with the present teachings includes contacting at least a portion of the engine cooling system with a cleaning composition of a type described herein. In some embodiments, the engine cooling system may include one or a plurality of aluminum surfaces. In some embodiments, the cleaning includes removing oil and at least one corrosion by-product from the engine cooling system in the same system flush. In other embodiments, the cleaning includes removing oil, fuel, and at least one corrosion by-product from the engine cooling system in the same system flush. The type of corrosion by-product removable using cleaning compositions in accordance with the present teachings. However, in some embodiments, the at least one one corrosion by-product is selected from the group consisting of a metal oxide, rust, engine scale, silicate gel, and a combination thereof.

The following examples and representative procedures illustrate features in accordance with the present teachings, and are provided solely by way of illustration. They are not intended to limit the scope of the appended claims or their equivalents.

EXAMPLES

Example 1—Representative Formulation of a Flush and Degreaser Cleaning Composition A representative formulation of a flush and degreaser cleaning composition in accordance with the present teachings is shown in Table 1.

TABLE 1

Representative Formulation of Cleaning Composition.

| 2738-23 | % wt. | (g)rams |
|---|---|---|
| Soft Water | 70.14 | 2651.29 |
| Citric Acid, 50% wt. | 10.02 | 378.76 |
| NaOH, 50% wt. | 6.57 | 248.35 |
| DePHOS H-66-872 | 6.00 | 226.80 |
| Foam Ban 3598B | 0.10 | 3.78 |
| Genapol LA 070 S | 3.25 | 122.85 |
| Butyl Carbitol | 2.00 | 75.60 |
| Genapol LA 030 | 1.75 | 66.15 |
| Acticide MBS 2550 | 0.15 | 5.67 |
| Chromatint Bright Green 1707 | 0.02 | 0.76 |
| Total | 100.00 | 3780.00 |

The per gallon treat rate of a cleaning composition in accordance with the present teachings may be determined by dividing the number of grams shown in the third column of Table 1 by 16.

While neither desiring to be bound by any particular theory nor intending to limit in any measure the scope of the appended claims or their equivalents, it is presently believed that the functions provided by the various ingredients of the representative formulation shown in Table 1 are as shown in Table 2 below.

TABLE 2

Functions of Ingredients of Representative Formulation of Cleaning Composition.

| 2738-23 | Function |
|---|---|
| Soft Water | Carrier for the active ingredients. |
| Citric Acid, 50% wt. NaOH, 50% wt. | Reaction of citric acid with sodium hydroxide yields sodium citrate which is metal chelator and descalent. |
| DePHOS H-66-872 | Phosphate ester hydrotrope to solublize the 2 surfactants in the formula. |
| Genapol LA 070 S | Nonionic surfactant, HLB = 12.4, to remove motor oil from metal surfaces. |
| Butyl Carbitol | diethylene glycol monobutyl ether, coupling agent |
| Genapol LA 030 | Nonionic surfactant, HLB = 8.0, to remove motor oil from metal surfaces. |
| Acticide MBS 2550 | Biocide |
| Foam Ban 3529B | Antifoam |
| Chromatint Bright Green 1707 | Dye |

In the Examples described below, cleaning compositions in accordance with the present teachings—including but not limited to compositions having the formulation shown in Table 1 above—may be variously referred to as "cleaning compositions" and "flush and degreaser cleaning compositions."

Example 2—Representative Method for Using Cleaning Composition in HD Applications The cooling system was drained. One gallon (3.78 liters) of a flush and degreaser cleaning composition having a formulation as shown in Table 1 was added, and the system was refilled with water. Systems larger than 16 gallons may require a second one gallon bottle of the cleaning composition.

The engine was brought up to operating temperature and the liquid was circulated through the entire cooling system for at least 45 minutes. Systems that are especially dirty or oily may be run for up to 3 hours.

The cooling system was thoroughly flushed.

The cooling system was drained and half of the cooling system capacity was loaded with antifreeze/coolant. The system was topped off with water, and the liquid was thoroughly mixed by driving.

Finally, the coolant concentration was verified and topped off as needed.

Example 3—Bench Top Methods for Testing Heavy-Duty Engines

Many types of engine coolant cleaners recommend that all coolant be drained from the cooling system prior to cleaning. However, once the engine is drained, 40-60% of residual 50/50 engine coolant may remain inside the engine. The flush and degreaser cleaning compositions in accordance with the present teachings are designed with this in mind, and may be used in the presence of leftover used coolant.

Heavy-duty engines have a 16-gallon capacity for engine coolant. After draining, as much as 60% leftover coolant may remain. Thus, after adding cleaning composition to the system and filling the system with water, the concentration is roughly 30% engine coolant and 70% water. For testing purposes, a mixture of 30 vol. % engine coolant and 70 vol. % water is combined with the proper concentration of cleaner and used to test efficacy of the cleaning composition.

To simulate a heavy-duty engine for testing purposes, various bench top methods were produced. All of the bench top methods utilize the same testing equipment. The equipment used includes a 1000-mL beaker containing 30% engine coolant concentrate, 70% water, and 60.50 mL of a cleaning composition having a formulation as shown in Table 1, a hot plate/thermocouple to heat the solution to 190° F. (engine running temperature), a magnetic stir bar, and a stopwatch to circulate the solution for the recommended 60-minute time interval. This method may be used to quantify the efficacy of various cleaning formulation in removing contaminants including but not limited to corrosion by-products, hydrocarbons, oily rust, silicate gel, scale, and/or the like.

Example 4—Metal Oxide Removal

Eighteen coupons of iron, steel, and cast aluminum were placed in 2-fl. oz. glass jars containing a 1.0 wt. % solution of NaCl. The jars were placed in the 90° C. oven for 3 days to corrode the samples. The samples were removed, rinsed with DI water, dried in the oven for 1 hr. at 90° C., and stored in a desiccator until used. The initial mass of each metal test specimen was weighed to a tenth of a milligram using a digital analytical balance and recorded.

Bundles of 6 coupons of each test metal were assembled using the same procedure as in ASTM D1384-05 except that the ends had 0.0625" PTFE washers whereas each of the 6 coupons was separated using a 0.125" PTFE washer. To a 1000-mL reflux beaker filled with 562.44+/−0.05 g of a 30 vol. % Prestone Command Heavy Duty Extended Life Antifreeze Coolant/70 vol. % tap water (v/v) was added 37.56 g of the cleaning composition. The solution was stirred at 150 RPMs using a 7/16" dia.×1.5" octagonal Teflon stir bar closer to the left side of the beaker. Using a bundle retriever, the bundles were lowered into the solution. The beaker was fitted with its 3-port condenser top and with a thermocouple that was attached to the hot plate from one of the side ports. The other 2 ports were plugged with rubber stoppers. The controller was set to 190° F. and the fluid was allowed to circulate using a 7/16'×2" octagonal PTFE magnetic stir bar at 190° F. for 60 or 90 minutes depending on the time selected for investigation.

Once the 90 minutes were completed, the metal test specimen bundle was removed from the solution and rinsed with deionized water. The bundle was disassembled, each coupon was rinsed with DI water and placed in a 100-mL glass Pyrex beaker to dry in a 100° F. oven for 1 hr. The specimens were taken out of the oven and allowed to cool for 20 minutes in the desiccator. They were immediately weighed to a tenth of a milligram and the mass recorded. The weight loss or gain in mgs was calculated. This was the mass of corrosion products removed. Tests were run in triplicate and an average was calculated.

The cast iron metal oxide removal data from this testing are summarized in Tables 3 and 4 below.

TABLE 3

Cast Iron Metal Oxide Removal Data (Test Duration 1 hour).
Metal: Cast Fe
Test Duration: 1 hr.
Test Temp.: 90° C.
Formula # 2738-8B

| Bundle #: 1 | | | | | | | |
|---|---|---|---|---|---|---|---|
| | Test Coupon # | | | | | | |
| | 1 | 2 | 3 | 4 | 5 | 6 | Total |
| Final Wt. (g) | 31.6864 | 24.6569 | 28.5429 | 31.9244 | 31.9139 | 37.4749 | |
| Initial Wt. (g) | 31.6865 | 24.6565 | 28.5431 | 31.9246 | 31.9143 | 37.4751 | |
| Wt. Gain/Loss (g) | −0.0001 | 0.0004 | −0.0002 | −0.0002 | −0.0004 | −0.0002 | −0.0007 |

| Bundle #: 2 | | | | | | | |
|---|---|---|---|---|---|---|---|
| | Test Coupon # | | | | | | |
| | 7 | 8 | 9 | 10 | 11 | 12 | Total |
| Final Wt. (g) | 28.8528 | 25.5839 | 25.6366 | 28.3341 | 30.7812 | 32.6856 | |
| Initial Wt. (g) | 28.853 | 25.5832 | 25.6365 | 28.3344 | 30.7814 | 32.6857 | |
| Wt. Gain/Loss (g) | −0.0002 | 0.0007 | 0.0001 | −0.0003 | −0.0002 | −0.0001 | 0.0000 |

| Bundle #: 3 | | | | | | | |
|---|---|---|---|---|---|---|---|
| | Test Coupon # | | | | | | |
| | 13 | 14 | 15 | 16 | 17 | 18 | Total |
| Final Wt. (g) | 32.6745 | 26.7959 | 31.7931 | 27.6242 | 27.7102 | 28.3737 | |
| Initial Wt. (g) | 32.6749 | 26.7958 | 31.7935 | 27.6245 | 27.7105 | 28.374 | |

TABLE 3-continued

| Cast Iron Metal Oxide Removal Data (Test Duration 1 hour). Metal: Cast Fe Test Duration: 1 hr. Test Temp.: 90° C. Formula # 2738-8B | | | | | | | |
|---|---|---|---|---|---|---|---|
| Wt. Gain/Loss (g) | −0.0004 | 0.0001 | −0.0004 | −0.0003 | −0.0003 | −0.0003 | −0.0016 |
| | | | | | | | Avg. −0.0008 |

TABLE 4

Cast Iron Metal Oxide Removal Data (Test Duration 1.5 hour).
Metal: Cast Fe
Test Duration: 1.5 hr.
Test Temp.: 90° C.
Formula # 2738-8B

| Bundle #: 1 | | | | | | | |
|---|---|---|---|---|---|---|---|
| | Test Coupon # | | | | | | |
| | 1 | 2 | 3 | 4 | 5 | 6 | Total |
| Final Wt. (g) | 27.9638 | 27.0661 | 30.6612 | 31.6291 | 30.4023 | 28.106 | |
| Initial Wt. (g) | 27.9646 | 27.0672 | 30.6619 | 31.63 | 30.4033 | 28.1066 | |
| Wt. Gain/Loss (g) | −0.0008 | −0.0011 | −0.0007 | −0.0009 | −0.001 | −0.0006 | −0.0051 |

| Bundle #: 2 | | | | | | | |
|---|---|---|---|---|---|---|---|
| | Test Coupon # | | | | | | |
| | 1 | 2 | 3 | 4 | 5 | 6 | Total |
| Final Wt. (g) | 29.3068 | 27.7029 | 32.3333 | 32.2047 | 32.6455 | 28.5139 | |
| Initial Wt. (g) | 29.3068 | 27.7031 | 32.3333 | 32.2048 | 32.6461 | 28.5145 | |
| Wt. Gain/Loss (g) | 0.0000 | −0.0002 | 0.0000 | −0.0001 | −0.0006 | −0.0006 | −0.0015 |

| Bundle #: 3 | | | | | | | |
|---|---|---|---|---|---|---|---|
| | Test Coupon # | | | | | | |
| | 1 | 2 | 3 | 4 | 5 | 6 | Total |
| Final Wt. (g) | 29.7482 | 31.4412 | 29.3764 | 27.4439 | 32.6472 | 31.5323 | |
| Initial Wt. (g) | 29.7487 | 31.4413 | 29.3765 | 27.4441 | 32.6476 | 31.5323 | |
| Wt. Gain/Loss (g) | −0.0005 | −0.0001 | −0.0001 | −0.0002 | −0.0004 | 0.0000 | −0.0013 |
| | | | | | | | Avg. −0.0026 |

The steel metal oxide removal data from this testing are summarized in Tables 5 and 6 below.

TABLE 5

Steel Metal Oxide Removal Data (Test Duration 1 hour).
Metal: Steel
Test Duration: 1 hr.
Test Temp.: 90° C.
Formula # 2738-8B Bundle #: 1

| | Test Coupon # | | | | | | |
|---|---|---|---|---|---|---|---|
| | 1 | 2 | 3 | 4 | 5 | 6 | Total |
| Final Wt. (g) | 14.4223 | 14.5012 | 14.4043 | 14.0869 | 14.4224 | 14.2546 | |
| Initial Wt. (g) | 14.4225 | 14.5013 | 14.4048 | 14.0868 | 14.4220 | 14.2545 | |
| Wt. Gain/Loss (g) | −0.0002 | −0.0001 | −0.0005 | 0.0001 | 0.0004 | 0.0001 | −0.0002 |

Bundle #: 2

| | Test Coupon # | | | | | | |
|---|---|---|---|---|---|---|---|
| | 7 | 8 | 9 | 10 | 11 | 12 | Total |
| Final Wt. (g) | 14.1271 | 14.4145 | 15.3871 | 14.407 | 14.5789 | 14.1038 | |
| Initial Wt. (g) | 14.1274 | 14.4146 | 15.3872 | 14.4074 | 14.5793 | 14.104 | |
| Wt. Gain/Loss (g) | −0.0003 | −0.0001 | −0.0001 | −0.0004 | −0.0004 | −0.0002 | −0.0015 |

Bundle #: 3

| | Test Coupon # | | | | | | |
|---|---|---|---|---|---|---|---|
| | 13 | 14 | 15 | 16 | 17 | 18 | Total |
| Final Wt. (g) | 14.1737 | 14.4179 | 14.4611 | 14.2614 | 14.3785 | 14.2631 | |
| Initial Wt. (g) | 14.1738 | 14.4187 | 14.4619 | 14.2617 | 14.3787 | 14.2635 | |
| Wt. Gain/Loss (g) | −0.0001 | −0.0008 | −0.0008 | −0.0003 | −0.0002 | −0.0004 | −0.0026 |
| | | | | | | | Avg. −0.0014 |

TABLE 6

Steel Metal Oxide Removal Data (Test Duration 1.5 hour).
Metal: Steel
Test Duration: 1.5 hr.
Test Temp.: 90° C.
Formula # 2738-8B Bundle #: 1

| | Test Coupon # | | | | | | |
|---|---|---|---|---|---|---|---|
| | 1 | 2 | 3 | 4 | 5 | 6 | Total |
| Final Wt. (g) | 14.3014 | 14.5282 | 15.4555 | 14.2965 | 14.3643 | 15.5327 | |
| Initial Wt. (g) | 14.3017 | 14.5285 | 15.4556 | 14.2969 | 14.3646 | 15.5332 | |
| Wt. Gain/Loss (g) | −0.0003 | −0.0003 | −1E−04 | −0.0004 | −0.0003 | −0.0005 | −0.0019 |

Bundle #: 2

| | Test Coupon # | | | | | | |
|---|---|---|---|---|---|---|---|
| | 7 | 8 | 9 | 10 | 11 | 12 | Total |
| Final Wt. (g) | 15.4218 | 14.4650 | 15.3883 | 14.4732 | 14.4231 | 14.3436 | |
| Initial Wt. (g) | 15.4221 | 14.4653 | 15.3890 | 14.4740 | 14.4240 | 14.3442 | |
| Wt. Gain/Loss (g) | −0.0003 | −0.0003 | −0.0007 | −0.0008 | −0.0009 | −0.0006 | −0.0036 |

TABLE 6-continued

Steel Metal Oxide Removal Data (Test Duration 1.5 hour).
Metal: Steel
Test Duration: 1.5 hr.
Test Temp.: 90° C.
Formula # 2738-8B

| Bundle #: 3 | | | | | | | |
|---|---|---|---|---|---|---|---|
| | Test Coupon # | | | | | | |
| | 13 | 14 | 15 | 16 | 17 | 18 | Total |
| Final Wt. (g) | 15.3682 | 15.5126 | 14.2313 | 14.5063 | 14.3507 | 14.5863 | |
| Initial Wt. (g) | 15.3685 | 15.5128 | 14.2315 | 14.5064 | 14.3509 | 14.5870 | |
| Wt. Gain/Loss (g) | −0.0003 | −0.0002 | −0.0002 | −0.0001 | −0.0002 | −0.0007 | −0.0017 |
| | | | | | | | Avg. −0.0024 |

The cast aluminum oxide removal data from this testing are summarized in Tables 7 and 8 below.

TABLE 7

Cast Aluminum Oxide Removal Data (Test Duration 1 hour).
Metal: Cast Al
Test Duration: 1 hr.
Test Temp.: 90° C.
Formula # 2738-8B

| Bundle #: 1 | | | | | | | |
|---|---|---|---|---|---|---|---|
| | Test Coupon # | | | | | | |
| | 1 | 2 | 3 | 4 | 5 | 6 | Total |
| Final Wt. (g) | 11.8100 | 11.4783 | 10.0390 | 10.9985 | 13.5290 | 9.8755 | |
| Initial Wt. (g) | 11.8110 | 11.4800 | 10.0423 | 11.0005 | 13.5297 | 9.8779 | |
| Wt. Gain/Loss (g) | −0.0010 | −0.0017 | −0.0033 | −0.0020 | −0.0007 | −0.0024 | −0.0111 |

| Bundle #: 2 | | | | | | | |
|---|---|---|---|---|---|---|---|
| | Test Coupon # | | | | | | |
| | 7 | 8 | 9 | 10 | 11 | 12 | Total |
| Final Wt. (g) | 11.2118 | 11.4836 | 11.9607 | 10.2149 | 9.874 | 10.7307 | |
| Initial Wt. (g) | 11.214 | 11.4859 | 11.9618 | 10.2172 | 9.8775 | 10.7331 | |
| Wt. Gain/Loss (g) | −0.0022 | −0.0023 | −0.0011 | −0.0023 | −0.0035 | −0.0024 | −0.0138 |

| Bundle #: 3 | | | | | | | |
|---|---|---|---|---|---|---|---|
| | Test Coupon # | | | | | | |
| | 13 | 14 | 15 | 16 | 17 | 18 | Total |
| Final Wt. (g) | 10.106 | 11.1894 | 10.0373 | 12.3376 | 11.5891 | 12.5842 | |
| Initial Wt. (g) | 10.1074 | 11.1933 | 10.0394 | 12.3404 | 11.5928 | 12.587 | |
| Wt. Gain/Loss (g) | −0.0014 | −0.0039 | −0.0021 | −0.0028 | −0.0037 | −0.0028 | −0.0167 |
| | | | | | | | Avg. (g) −0.0139 |

TABLE 8

Cast Aluminum Oxide Removal Data (Test Duration 1.5 hour).
Metal: Cast Al
Test Duration: 1.5 hr.
Test Temp.: 90° C.
Formula # 2738-8B

| Bundle #: 1 | | | | | | | |
|---|---|---|---|---|---|---|---|
| | Test Coupon # | | | | | | |
| | 1 | 2 | 3 | 4 | 5 | 6 | Total |
| Final Wt. (g) | 11.7679 | 11.4695 | 12.2817 | 12.2018 | 12.4797 | 12.3641 | |
| Initial Wt. (g) | 11.7679 | 11.4702 | 12.2829 | 12.2029 | 12.4803 | 12.3653 | |
| Wt. Gain/Loss (g) | 0 | −0.0007 | −0.0012 | −0.0011 | −0.0006 | −0.0012 | −0.0048 |
| Bundle #: 2 | | | | | | | |
| | 7 | 8 | 9 | 10 | 11 | 12 | Total |
| Final Wt. (g) | 11.606 | 12.3903 | 11.7349 | 12.3845 | 9.9119 | 10.2844 | |
| Initial Wt. (g) | 11.6084 | 12.3916 | 11.7357 | 12.3859 | 9.9137 | 10.2865 | |
| Wt. Gain/Loss (g) | −0.0024 | −0.0013 | −0.0008 | −0.0014 | −0.0018 | −0.0021 | −0.0098 |
| Bundle #: 3 | | | | | | | |
| | Test Coupon # | | | | | | |
| | 13 | 14 | 15 | 16 | 17 | 18 | Total |
| Final Wt. (g) | 12.6908 | 12.7464 | 10.3047 | 10.8183 | 12.8111 | 12.8564 | |
| Initial Wt. (g) | 12.6934 | 12.7476 | 10.307 | 10.82 | 12.812 | 12.8584 | |
| Wt. Gain/Loss (g) | −0.0026 | −0.0012 | −0.0023 | −0.0017 | −0.0009 | −0.002 | −0.0107 |
| | | | | | | | Total (g) −0.0084 |

Figure 2:
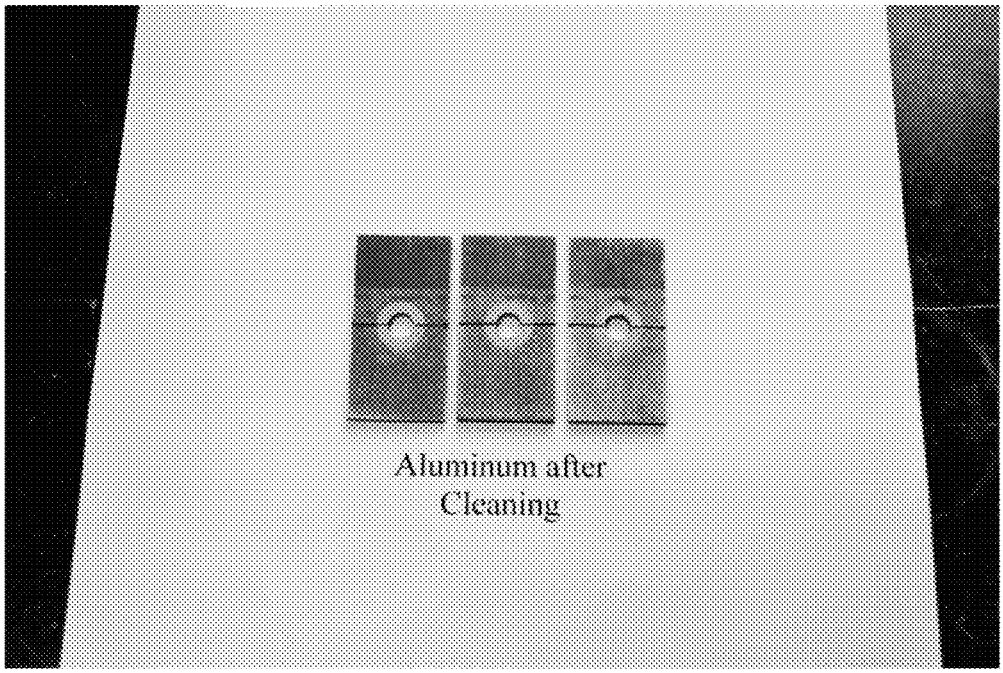
FIG. 2 shows a photograph of the aluminum samples of FIG. 1 after one hour of cleaning.

The metal oxide removal data summarized in Tables 3 through 8 show that a cleaning composition in accordance with the present teachings removes corrosion from most engine metals tested. FIG. 1 shows a photograph of corroded aluminum samples prior to cleaning, and FIG. 2 shows a photograph of the cleaned aluminum samples after 1 hour of cleaning.

Example 5—Oily Rust Removal

The oily rust test method is designed to test the efficacy of removing oils and fuel contamination from hard surface metal substrates. This test method replaces the metal bundles with a copper screen suspended by a metal hanger. The copper screen is coated with an oily rust mixture.

The oily rust soil preparation was as follows. Sensient® Red Iron Oxide BC pigment product #62050 (30.00+/0.05 grams) was weighed into a 4-fl. oz. Qorpak wide-mouth glass jar. The jar was charged with 5W-20 used motor oil (20.00+/−0.05 grams). It was mixed vigorously using a metal spatula and allowed to set overnight. The following morning, it was mixed vigorously again to break up any remaining agglomerates.

The test sample preparation was as follows. A 1.5"×1.5" square 0.0045" diameter copper wire-100×100 mesh, (ASTM E2016-06) sample was cut from a 12"×12" sheet. A line was drawn across the mesh 0.75" from the bottom straight across to the other side. The mesh was weighed on a digital analytical balance and the mass recorded. It was clamped into a 1.25" wide Universal medium binder clip, and the setup weighed on the analytical balance and recorded. Then the mesh was coated with the oily rust soil (0.1250+/−0.0050 grams) on one side of the mesh up to the line. It was set upright on a paper towel against a jar allowing the excess to drain onto the towel. After 10 minutes the excess oily rust soil was wiped off the bottom onto the paper towel, clamped in its binder clamp, and reweighed. Soil was added or wiped off the bottom until the mesh had 125+/−5 mg of oily rust coating it. A final weight was taken for the oily rust coated mesh binder clamp setup and the mass recorded.

A 1000-mL tall form glass beaker, KIMAX® No. 14020, without a pouring spout was fitted with a #15 Fisher brand rubber stopper having a 5-mm hole in the center. This hole was fitted with a thermocouple. A second hole was drilled approximately ¾" from the edge of the center hole to accommodate a 1.7-mm gauge stainless steel adjustable wire frame. From this frame was hung the 1.25"-wide Universal medium binder clip. Into this was clamped the half coated oily rust copper mesh, so that the black binder clip's top was just on the solution surface.

To a solution containing 492.14 g of 30 vol. % Prestone® Command Heavy Duty Antifreeze Coolant/70 vol. % tap water was added 32.86 g of the cleaning composition. The oily rust wire mesh was clamped to the rubber stopper wire frame assembly and lowered into the solution so that the black binder clip's top was just on the solution surface. The thermocouple was attached to a digital hot plate with digital magnetic stir and was lowered through the center hole of the rubber stopper top to regulate the solution temperature. The temperature was set on the digital hot plate to 185° F. Once the solution temperature reached 185° F. the hot plate was set for 190° F. This temperature was maintained for 90 minutes. The solution was stirred at 150 RPMs using a 7/16" dia.×2.5" octagonal Teflon stir bar.

Once the 90 minutes were completed, the oily rust wire mesh test specimen was removed from the solution. The corner farthest away from any remaining soil was touched to a paper towel to draw the remaining antifreeze solution from the sample. The top of the binder clip was identified by the formula page-replicate number and put in a glass or metal tray in the 100° C. oven overnight. After drying in the oven the oily rust wire mesh sample was taken out of the binder clip and weighed on the analytical balance, and the mass recorded.

The % removal for oily rust from the copper wire mesh was calculated using EQN (1) below, $$\%\ \text{removal} = \frac{\text{Initial Soil (mg)} - \text{Final Soil (mg)}}{\text{Initial Soil (mg)}} \times 100\%. \qquad \text{EQN (1)}$$

Three replicates were run and an average was calculated. The oily rust data for a copper mesh metal substrate are summarized in Tables 9 and 10 below.

TABLE 9

Oily Rust Data for Copper Mesh Metal Substrate
(Test Duration 1 hour).
Metal Substrate: Copper Mesh
Contaminent: Oily Rust
Time: 1 hr.
Temp: 90° C.
Formula#: 2738-8B

| | Sample # | | | |
|---|---|---|---|---|
| | 1 | 2 | 3 | Avg. |
| Screen/Oily Rust/Clip (g) | 9.4834 | 9.2896 | 9.5187 | |
| Screen/Clip (g) | 9.3565 | 9.1688 | 9.3999 | |
| Oily Rust (g) | 0.1269 | 0.1208 | 0.1188 | |
| Screen/Oily Rust Left (g) | 1.0270 | 0.9898 | 1.0091 | |
| Screen (g) | 0.9851 | 0.9613 | 0.9711 | |
| Oily Rust Left (g) | 0.0419 | 0.0285 | 0.0380 | 0.0361 |
| Oily Rust Removed (g) | 0.0850 | 0.0923 | 0.0808 | 0.0860 |
| % Oily Rust Removal | 66.98 | 76.41 | 68.01 | 70.47 |

TABLE 10

Oily Rust Data for Copper Mesh Metal Substrate
(Test Duration 1.5 hour).
Time: 1.5 hr.
Temp: 90° C.

| | Sample # | | | |
|---|---|---|---|---|
| | 1 | 2 | 3 | Avg. |
| Screen/Oily Rust/Clip (g) | 9.2951 | 9.1868 | 9.3043 | |
| Screen/Clip (g) | 9.1704 | 9.0629 | 9.1835 | |
| Oily Rust (g) | 0.1247 | 0.1239 | 0.1208 | |
| Screen/Oily Rust Left (g) | 0.9983 | 1.0107 | 0.9962 | |
| Screen (g) | 0.9717 | 0.9828 | 0.9711 | |
| Oily Rust Left (g) | 0.0266 | 0.0279 | 0.0251 | 0.0265 |
| Oily Rust Removed (g) | 0.0981 | 0.0960 | 0.0957 | 0.0966 |
| % Oil Rust Removal | 78.67 | 77.48 | 79.22 | 78.46 |

Figure 3:
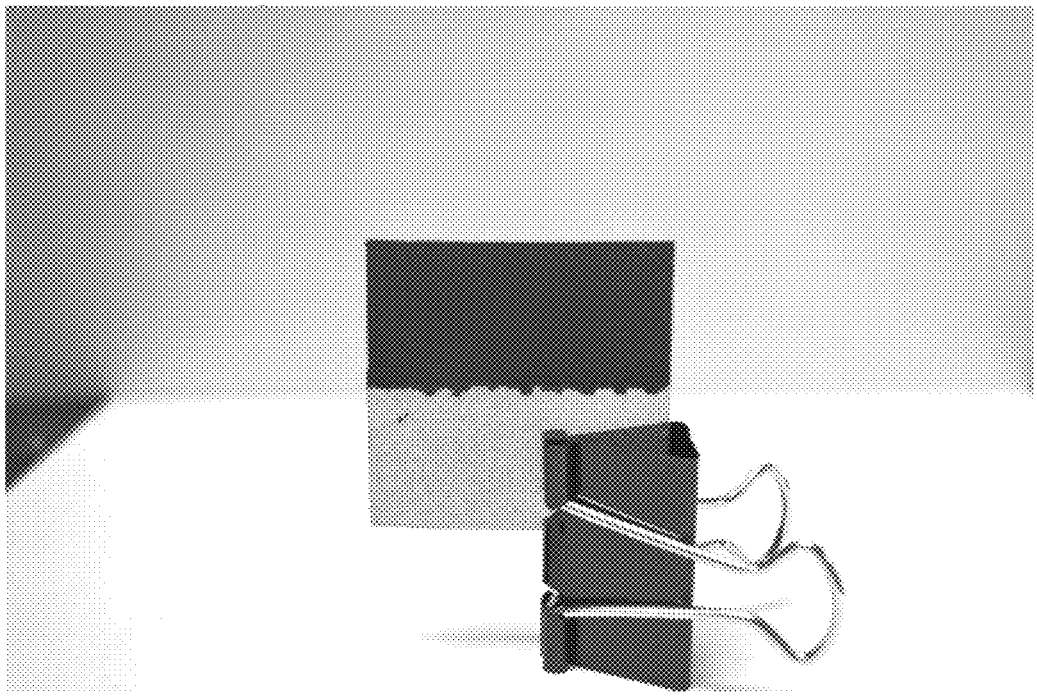
FIG. 3 shows a photograph of an oily rust sample before cleaning.
Figure 4:
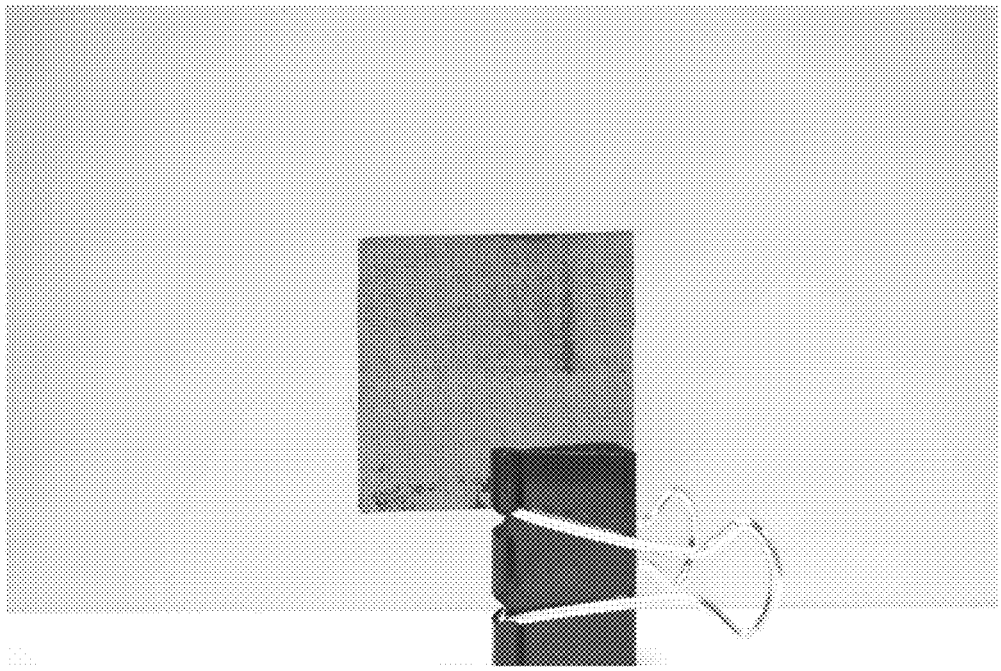
FIG. 4 shows a photograph of the sample of FIG. 3 after one hour of cleaning.

FIG. 3 shows a photograph of the initial oil rust sample prior to cleaning, and FIG. 4 shows a photograph of the cleaned oil rust sample after 1 hour of cleaning.

Example 6—Engine Scale Removal

A 250-mL glass beaker was filled with 100 mLs of DI water and set to stir on a magnetic stir plate. Sodium carbonate (0.8000+/−0.0050 grams) was dissolved into the DI water with stirring. A separate 250-mL glass beaker was filled with 100 mLs of DI water and set to stir on a magnetic stir plate. Calcium chloride (0.8000+/−0.0050) was dissolved into the water with stirring. Once all chemicals dissolved, a 1"×2" brass test specimen was placed on the bottom of the beaker containing the sodium carbonate solution. To this beaker, the calcium chloride solution was added and mixed using a glass stir or metal spatula. A white calcium carbonate precipitate began to form and deposit on the brass coupon, as shown in EQN (2) below.

$$CaCl_2 + Na_2CO_3 \rightarrow CaCO_3 + 2NaCl \qquad \text{EQN. (2)}$$

Figure 5:
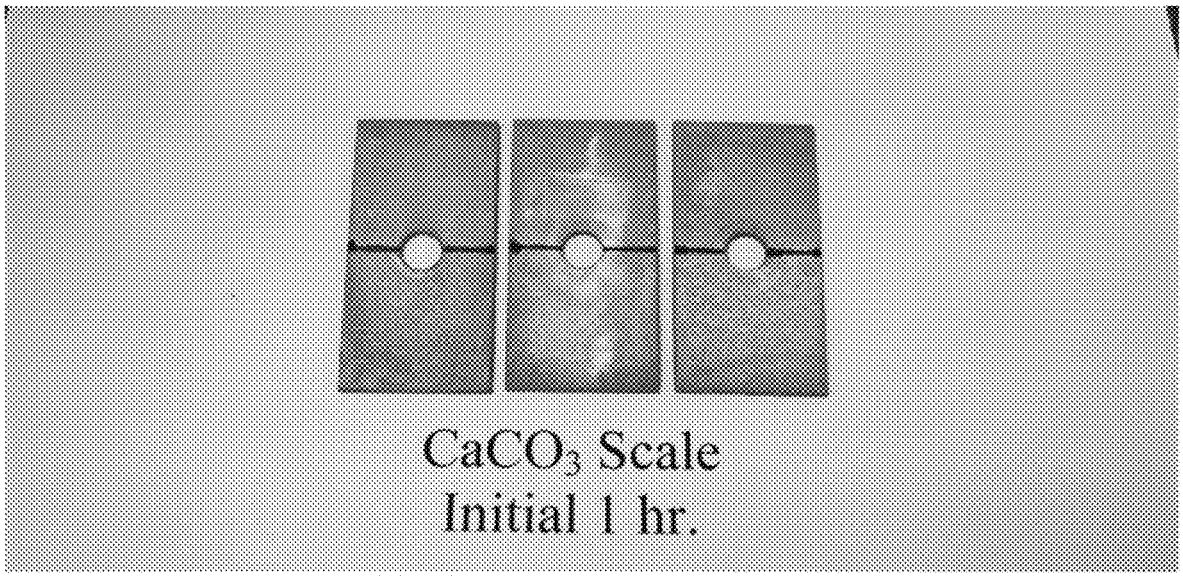
FIG. 5 shows a photograph of a $CaCO_3$ scale sample before cleaning.

Once the solution became clear, the brass test specimen was removed using a pair of tongs. The metal specimen was air dried first and then placed in the 100° C. oven for 2 hours. The coupon was allowed to cool to room temperature for 15 minutes. FIG. 5 shows an initial photograph taken of the calcium carbonate scale on the metal test specimens. The initial mass of each metal test specimen was weighed to a tenth of a milligram using a digital analytical balance and recorded.

A 1000-mL tall form glass beaker, KIMAX® No. 14020, without a pouring spout was fitted with a #15 Fisher brand rubber stopper having a 5-mm hole in the center. This hole was fitted with a thermocouple. A second hole was drilled approximately ¾" from the edge of the center hole to accommodate a 1.7-mm gauge stainless steel adjustable wire frame. From this frame was hung the 1.25" wide Universal medium binder clip. Into this was clamped the scale covered brass coupon, so that the coupon was submerged 1" into the solution.

To a solution containing 492.14 g of 30 vol. % Prestone® Command Heavy Duty Antifreeze Coolant/70 vol. % tap water was added 32.86 g of the cleaning composition. The scale covered brass coupon was clamped to the rubber stopper wire frame assembly and lowered into the solution so that the coupon was submerged 1" into the solution. The thermocouple was attached to a digital hot plate with digital magnetic stir and was lowered through the center hole of the rubber stopper top to regulate the solution temperature. The temperature was set on the digital hot plate to 185° F. Once the solution temperature reached 185° F., the hot plate was set for 190° F. This temperature was maintained for 60 minutes. The solution was stirred at 150 RPMs using a 7/16" dia.×2.5" octagonal Teflon stir bar.

Figure 6:
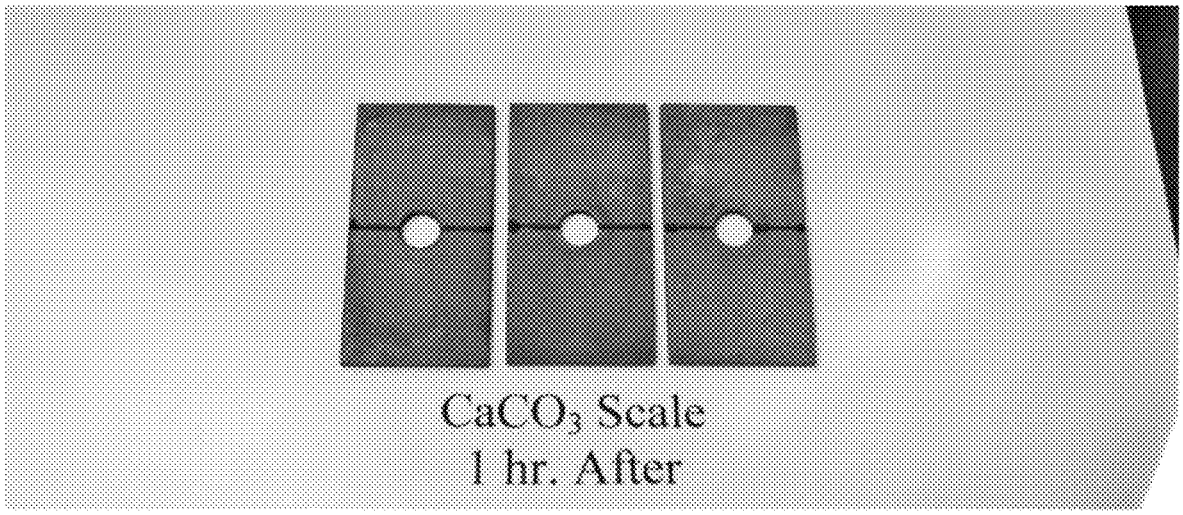
FIG. 6 shows a photograph of the sample of FIG. 5 after one hour of cleaning.

Once the 60 minutes was completed, the metal test specimen was removed from the solution and rinsed with deionized water. The specimen was placed in a 100-mL glass Pyrex beaker to dry in a 100° C. oven for 1 hour. The specimen was taken out of the oven and allowed to cool for 15 minutes in the desiccator. It was immediately weighed to a tenth of a milligram and the mass recorded. The weight loss in mgs was calculated as well as % scale removal. This was the mass of the scale products removed. FIG. 6 shows a final photograph of the metal test specimen after 1 hour of cleaning.

The % removal for scale from the brass metal specimen was calculated as shown in EQN (3) below.

$$\% \text{ removal} = \frac{\text{Initial Brass coupon with Scale (mg)} - \text{Final Brass coupon (mg)}}{\text{Initial Brass Coupon with scale (mg)}} \times 100 \quad \text{EQN. (3)}$$

Three replicates were run and an average calculated. The scale removal data for a brass metal substrate are summarized in Tables 11 and 12 below.

TABLE 11

Scale Removal Data for Brass Metal Substrate (Test Duration 1 hour).
Metal Substrate: Brass
Contaminant: $CaCO_3$ Scale
Time: 1 hr.
Temp: 90° C.

| | Sample # | | | |
|---|---|---|---|---|
| | 1 | 2 | 3 | Avg. |
| Brass + Scale (g) | 16.5328 | 16.5600 | 16.5912 | |
| Brass (g) | 16.5192 | 16.5238 | 16.5682 | |
| Scale on Brass (g) | 0.0136 | 0.0362 | 0.0230 | |
| Brass + Scale Final (g) | 16.5256 | 16.5341 | 16.5784 | |
| Brass + Scale Initial (g) | 16.5328 | 16.5600 | 16.5912 | |
| Scale Removed | −0.0072 | −0.0259 | −0.0128 | −0.0153 |
| % Scale Removal | 52.94 | 71.55 | 55.65 | 60.05 |

TABLE 12

Scale Removal Data for Brass Metal Substrate (Test Duration 1.5 hour).
Time: 1.5 hr.
Temp: 90° C.

| | Sample # | | | |
|---|---|---|---|---|
| | 1 | 2 | 3 | Avg. |
| Brass + Scale (g) | 17.0731 | 17.1502 | 16.9403 | |
| Brass (g) | 17.0406 | 17.1308 | 16.9253 | |
| Scale on Brass (g) | 0.0325 | 0.0194 | 0.0150 | |
| Brass + Scale Final (g) | 17.0477 | 17.1380 | 16.9303 | |
| Brass + Scale Initial (g) | 17.0731 | 17.1502 | 16.9403 | |
| Scale Removed | −0.0254 | −0.0122 | −0.0100 | −0.0159 |
| % Scale Removal | 78.15 | 62.89 | 66.67 | 69.24 |

Example 7—Silicate Gel Removal

Radiator pieces contaminated with silicate gel were obtained from a 1999 Suburban with 202,417 miles on it. Two 3"×3" sections of radiator end were cut from a radiator. The samples were weighed to a tenth of a milligram using a digital analytical balance and the mass recorded.

A 1000-mL tall form glass beaker, KIMAX® No. 14020, without a pouring spout was fitted with a #15 Fisher brand rubber stopper having a 5-mm hole in the center. This whole was fitted with a thermocouple. A second hole was drilled approximately ¾" from the edge of the center whole to accommodate a 1.7 mm gauge stainless steel adjustable wire frame. From this frame was hung the 1.25" wide Universal medium binder clip. Into this was clamped the 3"×3" radiator sample.

To a solution containing 492.14 g of 30 vol. % Prestone® Command Heavy Duty Antifreeze Coolant/70 vol. % tap water was added 32.86 g of the cleaning composition. The silicate-coated radiator section was clamped to the rubber stopper wire frame assembly and lowered into the solution so that the 3"×3" section was completely submerged. The thermocouple was attached to a digital hot plate with digital magnetic stir and was lowered through the center hole of the rubber stopper top to regulate the solution temperature. The temperature was set on the digital hot plate to 190° F. This temperature was maintained for 90 minutes. The solution was stirred at 150 RPMs using a 7/16" dia.×2.5" octagonal Teflon stir bar.

Once the 90 minutes were completed, the radiator section was removed from the solution. The radiator section was propped up on its side to drain most of the coolant/cleaner solution onto paper towels. The section was gently dipped into a liter beaker containing 900 mL of DI water followed by a second dip in another liter beaker of the same composition. Again the radiator section was propped up on its side to drain most of the DI water dip off onto paper towels. The section was placed into a 90° C. oven for 24 hours to dry. After drying in the oven, the radiator section was weighed on the analytical balance, and the mass recorded. Two replicates were run and an average calculated for milligrams removed. The silicate gel removal data for the radiator substrate are summarized in Table 13 below.

TABLE 13

Silicate Gel Removal Data.
Formula# 2738-8B
Test Duration: 1 hr.
Temp: 190° F.
Substrate: Radiator

| | Sample # | | |
|---|---|---|---|
| | 1 | 2 | Avg. |
| Final Radiator Wt. (g) | 52.4678 | 52.8133 | |
| Initial Rdaiator Wt. (g) | 53.3047 | 54.0494 | |
| Radiator Wt. Gain/Loss (g) | −0.8369 | −1.2361 | −1.0365 |
| Silicate Removed (g) | 0.8369 | 1.2361 | 1.0365 |
| Silicate Removed (mg) | 836.9 | 1236.1 | 1036.5 |

Example 8—Coolant Compatibility Testing

Coolant compatibility testing was achieved by using the same bench top protocol listed above. Testing was performed using a 30% solution of each of the 3 main types of HD engine coolants: Extended Life Nitrated formula—Red Cap, Extended Life Nitrate Free—Yellow Cap, and Heavy-Duty Pre Charged Silicate formula—Purple Cap. The 30% concentrated coolant was heated to operating temperature along with 70% water and an appropriate amount of cleaner for the capacity being tested.

The test sample preparation was as follows. A-1000 mL tall form glass beaker, KIMAX® No. 14020, without a pouring spout was fitted with a #15 Fisher brand rubber stopper having a 5-mm hole in the center. This hole was fitted with a thermocouple.

To a solution containing 492.14 g of 30 vol. % Prestone® Command Heavy Duty Antifreeze Coolant/70 vol. % tap water was added 32.86 g of the engine flush formula. Once the appropriate ingredients are added to the beaker, the beaker was placed on a hot plate.

The thermocouple was attached to a digital hot plate with digital magnetic stir bar and was lowered through the center hole of the rubber stopper top to regulate the solution temperature. The temperature was set on the digital hot plate to 185° F. Once the solution reached 185° F., the hot plate was set for 190° F. This temperature was maintained for 120 minutes. The solution was stirred at 150 RPMs using a 7/16" dia.×2.5" octagonal Teflon stir bar.

Once the fluid ran for 120 minutes, observations were recorded. Precipitate, phase separation, and residue are the three negative effects most commonly observed when fluids are not compatible. Each of the three HD engine coolants was run using this test method, and each fluid was tested in triplicate to ensure product compatibility with all types of HD engine coolant.

Initially, all three HD coolants were transparent and precipitate free. After 2.5 months stored at room temperature in glass jars, all three coolants remained transparent and precipitate free. No precipitate or phase separation occurred.

Example 9—Safe for HD Engine Parts Testing

The same bench top protocol described above was employed. Testing was performed using multiple parts found in the HD engine. The same solution used above was the test fluid which included 30% Command Engine Coolant concentrate, 70% water, and the appropriate amount of cleaner for the capacity being tested. The solution was heated and circulated for a total time of 8 hours at 190° F. Once the 8-hour time was completed, the parts were observed for any form of damage including staining, cracking, discoloration, oxidation, drying of rubber O-rings, and the like.

The cleaning composition was tested on the following engine parts: (1) a small rubber O-ring; (2) a larger rubber O-ring; (3) three rubber strips; (4) PVC tubing; (5) a hose connect; and (6) a spring thermostat. It was estimated that a minimum of 40% volume could be drained from the cooling system.

The treat rate for the cleaning composition was 1 gallon into a 16-gallon system which is 6.25% volume. The red Command Heavy Duty Extended Life Antifreeze/Coolant (900 mL) was blended into 2100 mL of tap water. Using the table on p. 360 of The Industrial Solvents Handbook, the density of this 30% volume coolant solution was found to be approximately 1.04 g/ml. Having a specific gravity of 1.0658 at 20° C., the density of the flush and degreaser cleaning composition was calculated to be 1.0639 g/ml at 20° C. 3000-mL batches of the coolant/tap water and cleaning composition were made up as follows.

Calculations:

0.0625 (3000 mL)=187.5 mL flush and degreaser cleaning composition 187.5 mL (1.0639 g/mL)=199.48 g flush and degreaser cleaning composition 2,812.5 mL 30 vol. % Command Coolant/70% vol. tap $H_2O$ (1.04 g/ml)=2,925.00 g A 4000-ml beaker was filled with 2,925.00+/−0.10 g of 30% vol. Command Extended Life Coolant/70% vol. tap $H_2O$ into which 199.48+/−0.05 g of flush and degreaser cleaning composition was added. This solution was blended for 5 minutes using a magnetic stir plate. The first five engine components described above were weighed using a digital analytical balance and recorded. Using a Mitutoyo Digimatic caliper, dimensional measurements were taken on the parts where applicable. A Shore® durometer was used on the rubber parts to test for any changes in hardness. Both O-rings and the rubber strips were placed in 2-fl. oz. glass jars and the jars were filled with 25 mL of the above solution. The three PVC tubes were placed in 4-oz. glass jars and filled with 70 mL of solution. The hose connect was placed in a 64-fl. oz. glass jar and filled with 800 mL of solution. The spring thermostat was placed in a 3-gallon stainless steel pot and filled with enough solution to cover the entire spring.

The glass jars were placed in the 90° C. oven for 24 hours. The spring thermostat in its solution was heat to 190° F. for 4 hours covered with aluminum foil on a hot plate. After the time had elapsed, the jars were removed from the ovens and the heat turned off on the thermostat. Once cool, the parts were removed from the solutions and rinsed well with DI water. The parts were measured and weighed again.

Observations were made and recorded. Any change in weight or dimensions was noted. The data for the HD engine parts are summarized in Tables 14-18 below. The solution that these parts were tested in was 28.125 vol. % Command Ext. Life Coolant, 65.625 vol. % tap water, and 6.25 vol. % flush and degreaser cleaning composition. These parts were left in for 24 hours at 90° C. and then for roughly a week at RT. It is more probable that any measurable change is due to the ethylene glycol as only 0.95 vol. % actives are contributed by the flush and degreaser cleaning composition.

TABLE 14

Rubber Strip Data.

| | Sample # | | | |
|---|---|---|---|---|
| | 1 | 2 | 3 | Avg. |
| Initial Weight (g) | 0.3437 | 0.3210 | 0.3451 | |
| Final Weight (g) | 0.3508 | 0.3276 | 0.3527 | |
| Weight Gain/Loss (g) | 0.0071 | 0.0066 | 0.0076 | |
| wt. % wt Gain/Loss | 2.0658 | 2.0561 | 2.2023 | 2.1080 |
| Sample # | 1 | 2 | 3 | |
| Initial Thickness (mm) | 2.43 | 2.52 | 2.36 | |
| Final Thickness (mm) | 2.47 | 2.58 | 2.38 | |
| Thickness Gain/Loss (mm) | 0.04 | 0.06 | 0.02 | |
| Thickness % wt Gain/Loss | 1.65 | 2.38 | 0.85 | 1.62 |
| Initial Width (mm) | 5.20 | 5.19 | 5.34 | |
| Final Width (mm) | 5.24 | 5.19 | 5.39 | |
| Width Gain/Loss (mm) | 0.04 | 0.00 | 0.05 | |
| Width % wt Gain/Loss | 0.77 | 0.00 | 0.94 | 0.57 |
| Initial Hardness (duros) | 59.00 | 61.00 | 58.50 | |
| Final Hardness (duros) | 60.00 | 60.50 | 59.00 | |
| Hardness Gain/Loss (duros) | 1.00 | −0.50 | 0.50 | |
| Hardness % wt Gain/Loss | 1.69 | −0.82 | 0.85 | 0.58 |

TABLE 15

Small O-Ring Data.

| | Sample # 1 |
|---|---|
| Initial Weight (g) | 0.2228 |
| Final Weight (g) | 0.2270 |
| Weight Gain/Loss (g) | 0.0042 |
| wt. % wt Gain/Loss | 1.8851 |

| | Measurement # | | | |
|---|---|---|---|---|
| | 1 | 2 | 3 | Avg. |
| Initial Thickness (mm) | 2.43 | 2.52 | 2.36 | |
| Final Thickness (mm) | 2.47 | 2.58 | 2.38 | |
| Thickness Gain/Loss (mm) | 0.04 | 0.06 | 0.02 | |
| Thickness % wt Gain/Loss | 1.65 | 2.38 | 0.85 | 1.62 |

TABLE 16

| Large O-Ring Data. | | | | |
|---|---|---|---|---|
| | | | Sample # 1 | |
| Initial Weight (g) | | | 0.3805 | |
| Final Weight (g) | | | 0.3817 | |
| Weight Gain/Loss (g) | | | 0.0012 | |
| wt. % wt Gain/Loss | | | 0.3154 | |
| | Measurement # | | | |
| | 1 | 2 | 3 | Avg. |
| Initial Thickness (mm) | 2.96 | 2.87 | 2.92 | |
| Final Thickness (mm) | 2.95 | 2.74 | 2.88 | |
| Thickness Gain/Loss (mm) | −0.01 | −0.13 | −0.04 | |
| Thickness % wt Gain/Loss | −0.34 | −4.53 | −1.37 | −2.08 |

TABLE 17

| Hose Connect Data. | | | | |
|---|---|---|---|---|
| | | | Sample # 1 | |
| Initial Weight (g) | | | 212.06 | |
| Final Weight (g) | | | 212.68 | |
| Weight Gain/Loss (g) | | | 0.62 | |
| wt. % wt Gain/Loss | | | 0.2924 | |
| | Sample # | | | |
| | 1 | 2 | 3 | Avg. |
| Initial Hardness (duros) | 72.00 | 71.00 | 71.50 | |
| Final Hardness (duros) | 72.00 | 72.00 | 72.50 | |
| Hardness Gain/Loss (duros) | 0.00 | 1.00 | 1.00 | |
| Hardness % wt Gain/Loss | 0.00 | 1.41 | 1.40 | 0.94 |
| | Measurement # | | | |
| | 1 | 2 | | Avg. |
| Initial Height (mm) | 69.67 | 69.70 | | |
| Final Height (mm) | 69.72 | 69.90 | | |
| Height Gain/Loss (mm) | 0.05 | 0.20 | | |
| Height % wt Gain/Loss | 0.07 | 0.29 | | 0.18 |

TABLE 18

| PVC Tubes Data. | | | | |
|---|---|---|---|---|
| | Sample # | | | |
| | 1 | 2 | 3 | Avg. |
| Initial Weight (g) | 2.8769 | 2.9097 | 2.9015 | |
| Final Weight (g) | 2.9217 | 2.9547 | 2.9459 | |
| Weight Gain/Loss (g) | 0.0448 | 0.0450 | 0.0444 | |
| wt. % wt Gain/Loss | 1.5572 | 1.5466 | 1.5302 | 1.5447 |
| Initial Width (mm) | 5.20 | 5.19 | 5.34 | |
| Final Width (mm) | 5.24 | 5.19 | 5.39 | |
| Width Gain/Loss (mm) | 0.04 | 0.00 | 0.05 | |
| Width % wt Gain/Loss | 0.77 | 0.00 | 0.94 | 0.57 |

Before and after weights and hardness measurements were compared and results show that no damage occurred while running the test.

Example 10—in Vehicle No Harm Testing

The flush and degreaser cleaning composition was run in a 1996 Diesel Ford F-250 for no harm testing. The product directions were followed and the product was allowed to stay in the vehicle for a total of 3 hours at operating temperature. During the 3 hour testing, samples were collected every 20 minutes. These samples were submitted to Analytical for ICP. ICP results can show how aluminum, iron, or other elemental concentrations change over time that would indicate harmful damage to cooling system.

The procedure used for the no harm testing was as follows.

(1) The surge tank cap was opened. Using a clean 60-mL syringe-type pipette, a 2-oz coolant sample #1 was syphoned from the system.

(2) The radiator drain valve was opened and the system was allowed to drain completely.

(3) The volume of engine coolant that came out was measured (17,325 mL, 17,675 actual mL), which allowed estimation of heal left in the system.

(4) The radiator drain valve was closed.

(5) Cleaner (1,916 grams) was added to the surge tank.

(6) The system was filled with a measured amount of water through the surge tank. The drained amount 17,675 mL−1,653 mL of cleaner=16,022 mL water was added. 520 mL of water were not able to fit in the system due to air bubble.

(7) System was filled.

(8) The truck was started, run at idle, and the cab heater was turned to high. Engine Start time=10:22 am.

(9) Once truck reached operating temperature and thermostat opened, the stopwatch was started and a 2-oz sample #2 was obtained from sampling valve. Truck took 2 hours to reach operating temperature (Time: 11:41 am) and then the sample was taken. Truck took over one hour longer to reach operating temperature due to the different heat transfer properties of engine coolant vs water. Therefore, the truck needed to be driven to be sure the cooling system was circulating. The truck was driven in a 9-mile loop taking roughly 20 minutes in time. After each 9-mile or 20-minute interval, a sample was collected from the sampling valve. The knob was twisted slowly to ensure no spillage occurred due to pressure built up in the system. Once the sample was taken, the knob was tightened to close.

(10) Truck was driven for a mileage roughly equal to 9 miles, which took approximately 20 minutes: (a) Start drive time=11:52 am; (b) Return from drive=12:12 am; (c) 2-oz. sample #3 was taken.

(11) Drove 9-mile loop once again: (a) Start drive time=12:15; (b) Return from drive=12:33; (c) 2-oz. sample #4 was taken.

(12) Drove 9-mile loop once again: (a) Start drive time=12:34; (b) Return from drive=12:55: (c) 2-oz. sample #5 was taken.

(13) Drove 9-mile loop once again: (a) Start drive time=12:56; (b) Return from drive=1:15; (c) 2-oz. sample #6 was taken.

(14) Drove 9-mile loop once again: (a) Start drive time=1:16; (b) Return from drive=1:33; (c) 2-oz. sample #7 was taken.

(15) Drove 9-mile loop once again: (a) Start drive time=1:35; (b) Return from drive=1:54; (c) 2-oz. sample #8 was taken.

(16) Drove 9-mile loop once again: (a) Start drive time=1:55; (b) Return from drive=2:12; (c) 2-oz. sample #9 was taken.

(17) Drove 9-mile loop once again: (a) Start drive time=2:14; (b) Return from drive=2:31; (cc) 2-oz. sample #10 was taken.

Flushing and Sampling No. 1

(18) Ensured engine was cool and no pressure was present by feeling and grasping upper radiator hose. The hose was cool to the touch and easily squeezed.

(19) The radiator drain valve was opened. A 2-oz. sample #11 was obtained from the drained fluid. The volume of fluid that came out was measured: 16,700 mL.

(20) The radiator drain valve was closed.

(21) Surge tank was opened and the system was refilled with water. Water amount added to the surge tank: 16,700 mL.

(22) The truck was started, run at idle, and the cab heater was turned to high. Start time: 9:35 am. Truck reached operating temperature: 10:50 am. The stopwatch was started.

Flushing and Sampling No. 2

(23) The engine was run with heater set to high for 15 minutes after reaching operating temperature. 15 minutes=11:05 am.

(24) A 2-oz. sample #12 was taken from sampling valve.

(25) Engine was turned off and allowed to cool overnight.

(26) Ensured engine was cool and no pressure was present by feeling and grasping upper radiator hose. Hose was cool to the touch and easily squeezed.

(27) The radiator drain valve was opened.

(28) The fluid was drained and the volume of fluid that came out was measured: 17,000 mL.

(29) The radiator drain valve was closed.

(30) Surge tank was opened and system was refilled with 17,000 mL water.

(31) The truck was started, run at idle, and the cab heater was turned to high. Truck start time: 9:30 am. Truck reached operating temperature: 10:43 am. The stopwatch was started.

Flushing and Sampling No. 3

(32) The engine was run with heater set to high for 15 minutes after reaching operating temperature. 15 minutes=10:55 am.

(33) A 2-oz. sample #13 was taken using the sampling valve.

(34) The engine was turned off and allowed to cool overnight.

(35) Ensured engine was cool and no pressure was present by feeling and grasping upper radiator hose. Hose was cool to the touch and easily squeezed.

(36) Opened radiator drain valve. Amount drained=17,350 mL.

(37) Closed radiator drain valve and reconnected lower radiator hoses.

(38) Opened surge tank and refilled system with water. Measured fluid amount drained: 17,350 mL.

(39) Started truck, ran at idle, and turned cab heater to high. Truck start time=9:50 am. Truck reached operating temperature=11:05 am. Started Stop watch.

Flushing and Sampling No. 4

(40) Ran engine with heater set to high for 15 minutes after reaching operating temperature. Time=11:20 am.

(41) Took a 2-oz. sample #13 using sampling valve.

(42) Turned engine off and allowed to cool overnight.

(43) Ensured engine was cool and no pressure present by feeling and grasping upper radiator hose. Hose was cool to the touch and easily squeezed.

(44) Opened radiator drain valve. Measured drained fluid: 18,000 mL.

(45) Took a 500-mL sample of fluid for analytical testing.

(46) Closed radiator drain valve.

Filling Engine with Concentrate

(47) Opened surge tank and added 13,000 mL of Prestone CorGuard Concentrated Antifreeze and 5000 mL of water to achieve a 50 wt. % concentration when system is full.

(48) Refilled remaining amount with water.

(49) Started truck, ran at idle, and turned cab heater to high.

(50) Ran engine with heater set to high for 15 minutes after reaching operating temperature to thoroughly mix engine coolant.

(51) Turned engine off and turned on blue fan to help cool engine, ran fan for 4 hours.

(52) Ensured engine was cool and no pressure present by feeling and grasping upper radiator hose. Hose was cool to the touch and easily squeezed.

(53) Opened surge tank and checked concentration of engine coolant.

The in vehicle no harm testing data are summarized in Tables 19-29 below. The analytical results show that aluminum and iron metal concentration did not become detectable over the entire duration of testing.

TABLE 19

Command Flush Coolant Sample Data.

| SampleID | Analyte | Mean |
|---|---|---|
| ANA # 566 | | |
| | Al | <2 |
| | B | 987.8 mg/L |
| | Ca | 3.599 mg/L |
| | Cu | <2 |
| | Fe | <2 |
| | K | 1197 mg/L |
| | Li | <2 |
| | Mg | 3.814 mg/L |
| | Mo | 125.1 mg/L |
| | Na | 4367 mg/L |
| | P | 834.4 mg/L |
| | Pb | <2 |
| | Si | 45.22 mg/L |
| | Sr | <2 |
| | Zn | <2 |

TABLE 20

Flush Sample #1 Data.

| SampleID | Analyte | Mean |
|---|---|---|
| ANA # 567 | | |
| | Al | <2 |
| | B | 371.2 mg/L |
| | Ca | 17.36 mg/L |
| | Cu | <2 |
| | Fe | <2 |
| | K | 1047 mg/L |
| | Li | <2 |
| | Mg | 6.679 mg/L |
| | Mo | 46.39 mg/L |
| | Na | 3227 mg/L |
| | P | 550.8 mg/L |
| | Pb | <2 |
| | Si | 28.26 mg/L |
| | Sr | <2 |
| | Zn | <2 |

TABLE 21

| Flush Sample #2 Data. | | |
|---|---|---|
| SampleID | Analyte | Mean |
| ANA # 568 | | |
| | Al | <2 |
| | B | 329.4 mg/L |
| | Ca | 16.58 mg/L |
| | Cu | <2 |
| | Fe | <2 |
| | K | 937.7 mg/L |
| | Li | <2 |
| | Mg | 6.527 mg/L |
| | Mo | 40.60 mg/L |
| | Na | 2874 mg/L |
| | P | 485.9 mg/L |
| | Pb | <2 |
| | Si | 25.75 mg/L |
| | Sr | <2 |
| | Zn | <2 |

TABLE 22

| Flush Sample #3 Data. | | |
|---|---|---|
| SampleID | Analyte | Mean |
| ANA # 569 | | |
| | Al | <2 |
| | B | 320.7 mg/L |
| | Ca | 19.83 mg/L |
| | Cu | <2 |
| | Fe | <2 |
| | K | 909.1 mg/L |
| | Li | <2 |
| | Mg | 7.630 mg/L |
| | Mo | 38.93 mg/L |
| | Na | 2793 mg/L |
| | P | 470.1 mg/L |
| | Pb | <2 |
| | Si | 25.29 mg/L |
| | Sr | <2 |
| | Zn | <2 |

TABLE 23

| Flush Sample #4 Data. | | |
|---|---|---|
| SampleID | Analyte | Mean |
| ANA # 570 | | |
| | Al | <2 |
| | B | 314.6 mg/L |
| | Ca | 16.07 mg/L |
| | Cu | <2 |
| | Fe | <2 |
| | K | 893.4 mg/L |
| | Li | <2 |
| | Mg | 7.076 mg/L |
| | Mo | 38.27 mg/L |
| | Na | 2734 mg/L |
| | P | 467.9 mg/L |
| | Pb | <2 |
| | Si | 25.26 mg/L |
| | Sr | <2 |
| | Zn | <2 |

TABLE 24

| Flush Sample #5 Data. | | |
|---|---|---|
| SampleID | Analyte | Mean |
| ANA # 571 | | |
| | Al | <2 |
| | B | 317.2 mg/L |
| | Ca | 16.56 mg/L |
| | Cu | <2 |
| | Fe | <2 |
| | K | 897.3 mg/L |
| | Li | <2 |
| | Mg | 7.191 mg/L |
| | Mo | 38.34 mg/L |
| | Na | 2745 mg/L |
| | P | 463.8 mg/L |
| | Pb | <2 |
| | Si | 26.45 mg/L |
| | Sr | <2 |
| | Zn | <2 |

TABLE 25

| Flush Sample #6 Data. | | |
|---|---|---|
| SampleID | Analyte | Mean |
| ANA # 572 | | |
| | Al | <2 |
| | B | 288.2 mg/L |
| | Ca | 15.77 mg/L |
| | Cu | <2 |
| | Fe | <2 |
| | K | 826.0 mg/L |
| | Li | <2 |
| | Mg | 6.770 mg/L |
| | Mo | 40.52 mg/L |
| | Na | 2535 mg/L |
| | P | 430.4 mg/L |
| | Pb | <2 |
| | Si | 25.29 mg/L |
| | Sr | <2 |
| | Zn | <2 |

TABLE 26

| Flush Sample #7 Data. | | |
|---|---|---|
| SampleID | Analyte | Mean |
| ANA # 573 | | |
| | Al | <2 |
| | B | 290.2 mg/L |
| | Ca | 16.77 mg/L |
| | Cu | <2 |
| | Fe | <2 |
| | K | 824.9 mg/L |
| | Li | <2 |
| | Mg | 6.971 mg/L |
| | Mo | 35.91 mg/L |
| | Na | 2566 mg/L |
| | P | 436.7 mg/L |
| | Pb | <2 |
| | Si | 25.38 mg/L |
| | Sr | <2 |
| | Zn | <2 |

TABLE 27

| Flush Sample #8 Data. | | |
|---|---|---|
| SampleID | Analyte | Mean |
| ANA # 574 | | |
| | Al | <2 |
| | B | 293.9 mg/L |
| | Ca | 15.29 mg/L |
| | Cu | <2 |
| | Fe | <2 |
| | K | 829.5 mg/L |
| | Li | <2 |
| | Mg | 6.869 mg/L |
| | Mo | 35.25 mg/L |
| | Na | 2584 mg/L |
| | P | 438.0 mg/L |
| | Pb | <2 |
| | Si | 25.86 mg/L |
| | Sr | <2 |
| | Zn | <2 |

TABLE 28

| Flush Sample #9 Data. | | |
|---|---|---|
| SampleID | Analyte | Mean |
| ANA # 575 | | |
| | Al | <2 |
| | B | 288.9 mg/L |
| | Ca | 14.91 mg/L |
| | Cu | <2 |
| | Fe | <2 |
| | K | 812.1 mg/L |
| | Li | <2 |
| | Mg | 6.636 mg/L |
| | Mo | 34.88 mg/L |
| | Na | 2558 mg/L |
| | P | 431.6 mg/L |
| | Pb | <2 |
| | Si | 25.78 mg/L |
| | Sr | <2 |
| | Zn | <2 |

TABLE 29

| Flush Sample #10 Data. | | |
|---|---|---|
| SampleID | Analyte | Mean |
| ANA # 576 | | |
| | Al | <2 |
| | B | 294.9 mg/L |
| | Ca | 14.72 mg/L |
| | Cu | <2 |

TABLE 29-continued

| Flush Sample #10 Data. | | |
|---|---|---|
| SampleID | Analyte | Mean |
| | Fe | <2 |
| | K | 817.4 mg/L |
| | Li | <2 |
| | Mg | 6.648 mg/L |
| | Mo | 35.16 mg/L |
| | Na | 2579 mg/L |
| | P | 438.7 mg/L |
| | Pb | <2 |
| | Si | 26.64 mg/L |
| | Sr | <2 |
| | Zn | <2 |

Example 11—ASTM Glassware Testing

The methodology described in ASTM D1384-05, Standard Test Method for Corrosion Test for Coolants in Glassware was used to evaluate the corrosion inhibitive properties of test solutions based on the weight changes incurred by various metal test specimens found in cooling systems. The metal specimens tested were copper, lead solder, brass, steel, cast iron, and cast aluminum.

The document ASTM D3306-11, Standard Specification for Glycol Based Engine Coolant for Automobile and Light Duty Service listed the specific performance requirements for ASTM D1384-05 as shown in Table 30 below.

TABLE 30

| Specific Performance Requirements for ASTM D1384-05. | |
|---|---|
| Corrosion in glassware Weight loss (mg)/specimen | Specific Values |
| Copper | 10 max |
| Lead Solder | 30 max |
| Brass | 10 max |
| Steel | 10 max |
| Cast Iron | 10 max |
| Aluminum | 30 max |

The flush and degreaser cleaning composition was run at full concentration for 2 hours in the Command Heavy-Duty Extended Life Nitrite Coolant during the last 2 hours of this test and met the specific values for all test metals. The flush and degreaser cleaning composition met the specific values for all the test metals in all 3 Command Heavy Duty Antifreeze Coolants at a 0.83% vol. (4 dilutions) heel concentration in the test. Four water flushes are the directed amount of dilutions after the use of this product.

The testing data are summarized in Tables 31-37 below.

TABLE 31

| Testing Data for 6.25 vol. % Cleaning Composition for 2 Hours at End. | | | | | | | |
|---|---|---|---|---|---|---|---|
| Bundle ID | 0 Blank | | | Bundle ID | 1 | | |
| H697524 | Initial Weight | Final Weight | Weight Loss | H697521 | Initial Weight | Final Weight | Weight Loss |
| Copper | 16.6686 | 16.668 | 0.0006 | Copper | 16.9578 | 16.956 | 0.0018 |
| ASTM | 17.0654 | 17.065 | 0.0004 | ASTM | 17.1694 | 17.1577 | 0.0117 |
| Brass | 16.7024 | 16.7011 | 0.0013 | Brass | 16.4079 | 16.4056 | 0.0023 |
| Steel | 14.3956 | 14.3958 | −0.0002 | Steel | 14.3936 | 14.3934 | 0.0002 |
| Cast Fe | 29.5945 | 29.5956 | −0.0011 | Cast Fe | 28.1546 | 28.1542 | 0.0004 |
| Cast Al | 10.9698 | 10.9699 | −0.0001 | Cast Al | 13.3718 | 13.3449 | 0.0269 |
| Hours | 0 | 336 | | Hours | 0 | 336 | |

TABLE 31-continued

Testing Data for 6.25 vol. % Cleaning Composition for 2 Hours at End.

| Bundle ID | 2 | | | Bundle ID | 3 | | |
|---|---|---|---|---|---|---|---|
| H697522 | Initial Weight | Final Weight | Weight Loss | H697523 | Initial Weight | Final Weight | Weight Loss |
| Copper | 16.7797 | 16.7775 | 0.0022 | Copper | 16.9583 | 16.9561 | 0.0022 |
| ASTM | 17.1428 | 17.1281 | 0.0147 | ASTM | 17.0965 | 17.0761 | 0.0204 |
| Brass | 16.6223 | 16.6198 | 0.0025 | Brass | 16.6704 | 16.6676 | 0.0028 |
| Steel | 14.5081 | 14.5077 | 0.0004 | Steel | 14.5278 | 14.5277 | 1E−04 |
| Cast Fe | 34.7259 | 34.7261 | −0.0002 | Cast Fe | 28.6801 | 28.6798 | 0.0003 |
| Cast Al | 12.1728 | 12.1443 | 0.0285 | Cast Al | 12.7334 | 12.7054 | 0.028 |
| Hours | 0 | 336 | | Hours | 0 | 336 | |

| | WEIGHT-LOSS Results | | | | | |
|---|---|---|---|---|---|---|
| BUNDLE ID | Copper | ASTM | Brass | Steel | Cast Fe | Cast Al |
| H697524 | 0.6 | 0.4 | 1.3 | −0.2 | −1.1 | −0.1 |
| L699011 | 1.8 | 11.7 | 2.3 | 0.2 | 0.4 | 26.9 |
| L699012 | 2.2 | 14.7 | 2.5 | 0.4 | −0.2 | 28.5 |
| L699013 | 2.2 | 20.4 | 2.8 | 0.1 | 0.3 | 28.0 |
| Average - Blank | 1.5 | 15.2 | 1.2 | 0.4 | 1.3 | 27.9 |
| Average - Blank mg/cm2 | 0.05 | 0.55 | 0.05 | | 0.04 | 0.95 |

TABLE 32

Testing Data for Command Heavy Duty Ext. Life (Red) - 1 Dilution

| | | | | | | | |
|---|---|---|---|---|---|---|---|
| Cast Al | 10.9698 | 10.9699 | −0.0001 | Cast Al | 12.613 | 12.5706 | 0.0424 |
| Hours | 0 | 336 | | Hours | 0 | 336 | |

| Bundle ID | 2 | | | Bundle ID | 3 | | |
|---|---|---|---|---|---|---|---|
| H697532 | Initial Weight | Final Weight | Weight Loss | H697533 | Initial Weight | Final Weight | Weight Loss |
| Copper | 16.9013 | 16.8912 | 0.0101 | Copper | 16.9335 | 16.9244 | 0.0091 |
| ASTM | 17.0299 | 16.9519 | 0.078 | ASTM | 17.1876 | 17.1168 | 0.0708 |
| Brass | 16.2029 | 16.1809 | 0.022 | Brass | 16.032 | 16.0135 | 0.0185 |
| Steel | 14.407 | 14.3972 | 0.0098 | Steel | 14.5461 | 14.5297 | 0.0164 |
| Cast Fe | 31.2915 | 31.2878 | 0.0037 | Cast Fe | 31.0775 | 31.0719 | 0.0056 |
| Cast Al | 10.861 | 10.8208 | 0.0402 | Cast Al | 12.0477 | 12.0025 | 0.0452 |
| Hours | 0 | 336 | | Hours | 0 | 336 | |

| | WEIGHT-LOSS Results | | | | | |
|---|---|---|---|---|---|---|
| BUNDLE ID | Copper | ASTM | Brass | Steel | Cast Fe | Cast Al |
| L697380 | 0.6 | 0.4 | 1.3 | −0.2 | −1.1 | −0.1 |
| H697531 | 10.2 | 78.5 | 20.5 | 11.4 | 3.7 | 42.4 |
| H697532 | 10.1 | 78.0 | 22.0 | 9.8 | 3.7 | 40.2 |
| H697533 | 9.1 | 70.8 | 18.5 | 16.4 | 5.6 | 45.2 |
| Average - Blank | 9.2 | 75.4 | 19.0 | 12.7 | 5.4 | 42.7 |
| Average - Blank mg/cm2 | 0.34 | 2.75 | 0.69 | 0.46 | 0.18 | 1.45 |

TABLE 33

Testing Data for Command Heavy Duty Ext. Life (Red) - 4 Dilutions.

| Bundle ID | 0 Blank | | | Bundle ID | 1 | | |
|---|---|---|---|---|---|---|---|
| L697380 | Initial Weight | Final Weight | Weight Loss | L697380 | Initial Weight | Final Weight | Weight Loss |
| Copper | 16.6686 | 16.668 | 0.0006 | Copper | 17.115 | 17.1092 | 0.0058 |
| ASTM | 17.0654 | 17.065 | 0.0004 | ASTM | 16.8892 | 16.8864 | 0.0028 |

TABLE 33-continued

Testing Data for Command Heavy Duty Ext. Life (Red) - 4 Dilutions.

| | | | | | | | |
|---|---|---|---|---|---|---|---|
| Brass | 16.7024 | 16.7011 | 0.0013 | Brass | 16.6554 | 16.646 | 0.0094 |
| Steel | 14.3956 | 14.3958 | −0.0002 | Steel | 14.4693 | 14.4653 | 0.004 |
| Cast Fe | 29.5945 | 29.5956 | −0.0011 | Cast Fe | 31.7207 | 31.7175 | 0.0032 |
| Cast Al | 10.9698 | 10.9699 | −0.0001 | Cast Al | 13.2581 | 13.2321 | 0.026 |
| Hours | 0 | 336 | | Hours | 0 | 336 | |
| Bundle ID | 2 | | | Bundle ID | 3 | | |
| L697380 | Initial Weight | Final Weight | Weight Loss | L697380 | Initial Weight | Final Weight | Weight Loss |
| Copper | 17.0837 | 17.078 | 0.0057 | Copper | 16.7725 | 16.7667 | 0.0058 |
| ASTM | 17.1371 | 17.1345 | 0.0026 | ASTM | 17.183 | 17.1805 | 0.0025 |
| Brass | 16.5893 | 16.5809 | 0.0084 | Brass | 16.618 | 16.6094 | 0.0086 |
| Steel | 14.5806 | 14.5766 | 0.004 | Steel | 14.5234 | 14.5192 | 0.0042 |
| Cast Fe | 31.9021 | 31.8994 | 0.0027 | Cast Fe | 31.7468 | 31.7431 | 0.0037 |
| Cast Al | 13.3005 | 13.2751 | 0.0254 | Cast Al | 12.4592 | 12.4324 | 0.0268 |
| Hours | 0 | 336 | | Hours | 0 | 336 | |

WEIGHT-LOSS Results

| BUNDLE ID | Copper | ASTM | Brass | Steel | Cast Fe | Cast Al |
|---|---|---|---|---|---|---|
| L697380 | 0.6 | 0.4 | 1.3 | −0.2 | −1.1 | −0.1 |
| H697541 | 5.8 | 2.8 | 9.4 | 4.0 | 3.2 | 26.0 |
| H697542 | 5.7 | 2.6 | 8.4 | 4.0 | 2.7 | 25.4 |
| H697543 | 5.8 | 2.5 | 8.6 | 4.2 | 3.7 | 26.8 |
| Average - Blank | 5.2 | 2.2 | 7.5 | 4.3 | 4.3 | 26.2 |
| Average - Blank mg/cm2 | 0.19 | 0.08 | 0.27 | 0.16 | 0.15 | 0.89 |

TABLE 34

Testing Data for Command Heavy Duty Nitrite Free.

| | | | | | | | |
|---|---|---|---|---|---|---|---|
| Bundle ID | 0 Blank | | | Bundle ID | 1 | | |
| L738190 | Initial Weight | Final Weight | Weight Loss | L738191 | Initial Weight | Final Weight | Weight Loss |
| Copper | 16.4363 | 16.4349 | 0.0014 | Copper | 17.0256 | 17.0238 | 0.0018 |
| ASTM | 16.8179 | 16.818 | −1E−04 | ASTM | 17.0614 | 17.0604 | 0.001 |
| Brass | 16.6749 | 16.673 | 0.0019 | Brass | 15.4564 | 15.4543 | 0.0021 |
| Steel | 15.4126 | 15.4122 | 0.0004 | Steel | 15.39 | 15.3892 | 0.0008 |
| Cast Fe | 29.7937 | 29.7929 | 0.0008 | Cast Fe | 29.2681 | 29.2687 | −0.0006 |
| Cast Al | 10.9607 | 10.9607 | 0 | Cast Al | 12.2555 | 12.2479 | 0.0076 |
| Hours | 0 | 336 | | Hours | 0 | 336 | |
| Bundle ID | 2 | | | Bundle ID | 3 | | |
| L738192 | Initial Weight | Final Weight | Weight Loss | L738193 | Initial Weight | Final Weight | Weight Loss |
| Copper | 16.6992 | 16.6974 | 0.0018 | Copper | 16.9644 | 16.9626 | 0.0018 |
| ASTM | 16.992 | 16.9909 | 0.0011 | ASTM | 16.9017 | 16.9004 | 0.0013 |
| Brass | 16.6842 | 16.6824 | 0.0018 | Brass | 16.7133 | 16.7114 | 0.0019 |
| Steel | 15.4927 | 15.4916 | 0.0011 | Steel | 15.3823 | 15.3813 | 0.001 |
| Cast Fe | 29.7949 | 29.7952 | −0.0003 | Cast Fe | 31.2468 | 31.2472 | −0.0004 |
| Cast Al | 11.9358 | 11.9255 | 0.0103 | Cast Al | 12.0654 | 12.0558 | 0.0096 |
| Hours | 0 | 336 | | Hours | 0 | 336 | |

WEIGHT-LOSS Results

| BUNDLE ID | Copper | ASTM | Brass | Steel | Cast Fe | Cast Al |
|---|---|---|---|---|---|---|
| L738190 | 1.4 | −0.1 | 1.9 | 0.4 | 0.8 | #REF! |
| L738191 | 1.8 | 1.0 | 2.1 | 0.8 | −0.6 | 7.6 |
| L738192 | 1.8 | 1.1 | 1.8 | 1.1 | −0.3 | 10.3 |
| L738193 | 1.8 | 1.3 | 1.9 | 1.0 | −0.4 | 9.6 |
| Average - Blank | 0.4 | 1.2 | 0.0 | 0.6 | −1.2 | #REF! |
| Average - Blank mg/cm2 | 0.01 | 0.05 | 0.00 | 0.02 | −0.04 | #REF! |

TABLE 35

Testing Data for Command Heavy Duty Nitrite Free - 4 Dilutions.

| Bundle ID | 0 Blank | | | Bundle ID | 1 | | |
|---|---|---|---|---|---|---|---|
| L738190 | Initial Weight | Final Weight | Weight Loss | L738201 | Initial Weight | Final Weight | Weight Loss |
| Copper | 16.4363 | 16.4349 | 0.0014 | Copper | 17.0042 | 17.0011 | 0.0031 |
| ASTM | 16.8179 | 16.818 | −1E−04 | ASTM | 17.0071 | 17.0041 | 0.003 |
| Brass | 16.6749 | 16.673 | 0.0019 | Brass | 16.7191 | 16.7142 | 0.0049 |
| Steel | 15.4126 | 15.4122 | 0.0004 | Steel | 15.448 | 15.4451 | 0.0029 |
| Cast Fe | 29.7937 | 29.7929 | 0.0008 | Cast Fe | 30.3326 | 30.3312 | 0.0014 |
| Cast Al | 10.9607 | 10.9607 | 0 | Cast Al | 11.9891 | 11.9672 | 0.0219 |
| Hours | 0 | 336 | | Hours | 0 | 336 | |
| Bundle ID | 2 | | | Bundle ID | 3 | | |
| L738202 | Initial Weight | Final Weight | Weight Loss | L738203 | Initial Weight | Final Weight | Weight Loss |
| Copper | 16.8844 | 16.8816 | 0.0028 | Copper | 16.1847 | 16.1818 | 0.0029 |
| ASTM | 16.9847 | 16.9823 | 0.0024 | ASTM | 16.95 | 16.9484 | 0.0016 |
| Brass | 16.7011 | 16.6964 | 0.0047 | Brass | 16.8439 | 16.8391 | 0.0048 |
| Steel | 15.3041 | 15.3015 | 0.0026 | Steel | 15.469 | 15.4658 | 0.0032 |
| Cast Fe | 30.87 | 30.8686 | 0.0014 | Cast Fe | 29.9343 | 29.9336 | 0.0007 |
| Cast Al | 11.6033 | 11.5823 | 0.021 | Cast Al | 13.1667 | 13.1457 | 0.021 |
| Hours | 0 | 336 | | Hours | 0 | 336 | |

| | WEIGHT-LOSS Results | | | | | |
|---|---|---|---|---|---|---|
| BUNDLE ID | Copper | ASTM | Brass | Steel | Cast Fe | Cast Al |
| L738190 | 1.4 | −0.1 | 1.9 | 0.4 | 0.8 | 0.0 |
| L738201 | 3.1 | 3.0 | 4.9 | 2.9 | 1.4 | 21.9 |
| L738202 | 2.8 | 2.4 | 4.7 | 2.6 | 1.4 | 21.0 |
| L738203 | 2.9 | 1.6 | 4.8 | 3.2 | 0.7 | 21.0 |
| Average - Blank | 1.5 | 2.4 | 2.9 | 2.5 | 0.4 | 21.3 |
| Average - Blank mg/cm2 | 0.06 | 0.09 | 0.11 | 0.09 | 0.01 | 0.72 |

TABLE 36

Testing Data for Command Heavy Duty Silicate Coolant.

| Bundle ID | 0 Blank | | | Bundle ID | 1 | | |
|---|---|---|---|---|---|---|---|
| L738190 | Initial Weight | Final Weight | Weight Loss | L738211 | Initial Weight | Final Weight | Weight Loss |
| Copper | 16.4363 | 16.4349 | 0.0014 | Copper | 17.057 | 17.0551 | 0.0019 |
| ASTM | 16.8179 | 16.818 | −1E−04 | ASTM | 17.1156 | 17.101 | 0.0146 |
| Brass | 16.6749 | 16.673 | 0.0019 | Brass | 16.6491 | 16.6466 | 0.0025 |
| Steel | 15.4126 | 15.4122 | 0.0004 | Steel | 15.391 | 15.3902 | 0.0008 |
| Cast Fe | 29.7937 | 29.7929 | 0.0008 | Cast Fe | 30.7046 | 30.7045 | 1E−04 |
| Cast Al | 10.9607 | 10.9607 | 0 | Cast Al | 10.8689 | 10.871 | −0.0021 |
| Hours | 0 | 336 | | Hours | 0 | 336 | |
| Bundle ID | 2 | | | Bundle ID | 3 | | |
| L738212 | Initial Weight | Final Weight | Weight Loss | L738213 | Initial Weight | Final Weight | Weight Loss |
| Copper | 16.1363 | 16.1342 | 0.0021 | Copper | 16.8682 | 16.8665 | 0.0017 |
| ASTM | 16.9279 | 16.9156 | 0.0123 | ASTM | 16.9161 | 16.9079 | 0.0082 |
| Brass | 16.7104 | 16.7078 | 0.0026 | Brass | 16.6922 | 16.6895 | 0.0027 |
| Steel | 15.2949 | 15.2938 | 0.0011 | Steel | 15.516 | 15.5155 | 0.0005 |
| Cast Fe | 30.3816 | 30.382 | −0.0004 | Cast Fe | 30.6874 | 30.6879 | −0.0005 |
| Cast Al | 12.2074 | 12.2082 | −0.0008 | Cast Al | 11.9245 | 11.9267 | −0.0022 |
| Hours | 0 | 336 | | Hours | 0 | 336 | |

| | WEIGHT-LOSS Results | | | | | |
|---|---|---|---|---|---|---|
| BUNDLE ID | Copper | ASTM | Brass | Steel | Cast Fe | Cast Al |
| L738190 | 1.4 | −0.1 | 1.9 | 0.4 | 0.8 | #REF! |
| L738211 | 1.9 | 14.6 | 2.5 | 0.8 | 0.1 | −2.1 |
| L738212 | 2.1 | 12.3 | 2.6 | 1.1 | −0.4 | −0.8 |

TABLE 36-continued

| Testing Data for Command Heavy Duty Silicate Coolant. | | | | | | |
|---|---|---|---|---|---|---|
| L738213 | 1.7 | 8.2 | 2.7 | 0.5 | −0.5 | −2.2 |
| Average - Blank | 0.5 | 11.8 | 0.7 | 0.4 | −1.1 | #REF! |
| Average - Blank mg/cm2 | 0.02 | 0.43 | 0.03 | 0.01 | −0.04 | #REF! |

TABLE 37

Command Heavy Duty Silicate Coolant - 4 Dilutions.

| Bundle ID | 0 Blank | | | Bundle ID | 1 | | |
|---|---|---|---|---|---|---|---|
| L738190 | Initial Weight | Final Weight | Weight Loss | L738221 | Initial Weight | Final Weight | Weight Loss |
| Copper | 16.4363 | 16.4349 | 0.0014 | Copper | 17.1854 | 17.184 | 0.0014 |
| ASTM | 16.8179 | 16.818 | −1E−04 | ASTM | 17.0008 | 16.9847 | 0.0161 |
| Brass | 16.6749 | 16.673 | 0.0019 | Brass | 16.6401 | 16.6374 | 0.0027 |
| Steel | 15.4126 | 15.4122 | 0.0004 | Steel | 15.5179 | 15.5169 | 0.001 |
| Cast Fe | 29.7937 | 29.7929 | 0.0008 | Cast Fe | 30.7564 | 30.7562 | 0.0002 |
| Cast Al | 10.9607 | 10.9607 | 0 | Cast Al | 12.3401 | 12.341 | −0.0009 |
| Hours | 0 | 336 | | Hours | 0 | 336 | |
| Bundle ID | 2 | | | Bundle ID | 3 | | |
| L738222 | Initial Weight | Final Weight | Weight Loss | L738223 | Initial Weight | Final Weight | Weight Loss |
| Copper | 17.1981 | 17.1961 | 0.002 | Copper | 17.1545 | 17.1534 | 0.0011 |
| ASTM | 16.8851 | 16.8666 | 0.0185 | ASTM | 17.0195 | 17.0059 | 0.0136 |
| Brass | 16.5964 | 16.5934 | 0.003 | Brass | 16.6276 | 16.6247 | 0.0029 |
| Steel | 15.524 | 15.523 | 0.001 | Steel | 15.4294 | 15.4284 | 0.001 |
| Cast Fe | 30.8066 | 30.807 | −0.0004 | Cast Fe | 30.2792 | 30.28 | −0.0008 |
| Cast Al | 12.6293 | 12.6301 | −0.0008 | Cast Al | 12.2018 | 12.2025 | −0.0007 |
| Hours | 0 | 336 | | Hours | 0 | 336 | |

| | WEIGHT-LOSS Results | | | | | |
|---|---|---|---|---|---|---|
| BUNDLE ID | Copper | ASTM | Brass | Steel | Cast Fe | Cast Al |
| L738190 | 1.4 | −0.1 | 1.9 | 0.4 | 0.8 | 0.0 |
| L738221 | 1.4 | 16.1 | 2.7 | 1.0 | 0.2 | −0.9 |
| L738222 | 2.0 | 18.5 | 3.0 | 1.0 | −0.4 | −0.8 |
| L738223 | 1.1 | 13.6 | 2.9 | 1.0 | −0.8 | −0.7 |
| Average - Blank | 0.1 | 16.2 | 1.0 | 0.6 | −1.1 | −0.8 |
| Average - Blank mg/cm2 | 0.00 | 0.59 | 0.04 | 0.02 | −0.04 | −0.03 |

The entire contents of each and every patent and non-patent publication cited herein—including but not limited to the two ASTM documents ASTM D3306-11 and ASTM D1384-05 referenced in Example 11—are hereby incorporated by reference, except that in the event of any inconsistent disclosure or definition from the present specification, the disclosure or definition herein shall be deemed to prevail.

It is to be understood that use of the indefinite articles "a" and "an" in reference to an element (e.g., "a carrier liquid," "a metal citrate," "an organophosphate hydrotrope," etc.) does not exclude the presence, in some embodiments, of a plurality of such elements.

The foregoing detailed description has been provided by way of explanation and illustration, and is not intended to limit the scope of the appended claims. Many variations in the presently preferred embodiments illustrated herein will be apparent to one of ordinary skill in the art, and remain within the scope of the appended claims and their equivalents.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims can, alternatively, be made to depend in the alternative from any preceding claim—whether independent or dependent—and that such new combinations are to be understood as forming a part of the present specification.

The invention claimed is:

1. A cleaning composition configured to remove a corrosion by-product and/or hydrocarbon contamination from an engine cooling system, the composition comprising:

(a) a carrier liquid;

(b) a metal citrate and/or a plurality of reagents configured to generate the metal citrate in situ;

(c) one or a plurality of non-ionic surfactants; and (d) an organophosphate hydrotrope configured to increase solubility of the one or the plurality of non-ionic surfactants in the carrier liquid;

wherein a pH of the cleaning composition ranges from about 9.0 to about 10.0.

2. The cleaning composition of claim 1 wherein the carrier liquid comprises water.

3. The cleaning composition of claim 2 wherein the water is deionized water, demineralized water, softened water, or a combination thereof.

4. The cleaning composition of claim 1 wherein the metal comprises an alkali metal.

5. The cleaning composition of claim 1 wherein the metal comprises an alkaline earth metal.

6. The cleaning composition of claim 1 wherein the metal citrate comprises sodium citrate.

7. The cleaning composition of claim 1 wherein the plurality of reagents comprises citric acid and a base.

8. The cleaning composition of claim 1 wherein the plurality of reagents comprises citric acid and sodium hydroxide.

9. The cleaning composition of claim 1 wherein a pH of the composition is about 9.5.

10. The cleaning composition of claim 1 wherein the one or the plurality of non-ionic surfactants comprises one or a plurality of $C_{12}$-$C_{15}$ non-ionic surfactants.

11. The cleaning composition of claim 1 wherein the one or the plurality of non-ionic surfactants comprises a $C_{12}$-$C_{15}$ fatty alcohol polyglycol ether.

12. The cleaning composition of claim 1 wherein the one or the plurality of non-ionic surfactants comprises a lauryl alcohol ethoxylate.

13. The cleaning composition of claim 1 wherein each of the one or the plurality of non-ionic surfactants has a hydrophile-lipophile balance (HLB) ranging from about 7.5 to about 13.0.

14. The cleaning composition of claim 1 wherein the one or the plurality of non-ionic surfactants comprises a first lauryl alcohol ethoxylate having an HLB of about 12.4 and a second lauryl alcohol ethoxylate having an HLB of about 8.0.

15. The cleaning composition of claim 1 wherein the organophosphate hydrotrope comprises an aromatic phosphate ester salt.

16. The cleaning composition of claim 1 wherein the organophosphate hydrotrope comprises an aromatic phosphate ester potassium salt.

17. The cleaning composition of claim 1 further comprising a glycol ether coupling agent.

18. The cleaning composition of claim 17 wherein the glycol ether coupling agent comprises butyl carbitol.

19. The cleaning composition of claim 1 further comprising a biocide agent, an antifoam agent, a dye, or a combination thereof.

20. A cleaning composition configured to remove a corrosion by-product and/or hydrocarbon contamination from an engine cooling system, the composition comprising:

(a) water in an amount ranging from about 60 wt. % to about 80 wt. % based on a total weight of the cleaning composition;

(b) citric acid in an amount ranging from about 8 wt. % to about 12 wt. % based on the total weight of the cleaning composition;

(c) an alkali metal hydroxide in an amount ranging from about 4 wt. % to about 8 wt. % based on the total weight of the cleaning composition;

(d) a first lauryl alcohol ethoxylate surfactant having an HLB of greater than about 10.0 and a second lauryl alcohol ethoxylate surfactant having an HLB of less than about 10.0, wherein the first lauryl alcohol ethoxylate surfactant and the second lauryl alcohol ethoxylate surfactant are present in a combined amount ranging from about 4 wt. % to about 6 wt. % based on the total weight of the cleaning composition; and (e) an aromatic phosphate ester salt in an amount ranging from about 5 wt. % to about 7 wt. % based on the total weight of the cleaning composition;

wherein a pH of the cleaning composition ranges from about 9.0 to about 10.0.

21. The cleaning composition of claim 20 further comprising a glycol ether coupling agent in an amount ranging from about 1 wt. % to about 3 wt. % based on the total weight of the cleaning composition.

22. The cleaning composition of claim 21 further comprising a biocide agent, an antifoam agent, and a dye in a combined amount ranging from about 0.10 wt. % to about 0.50 wt. % based on the total weight of the cleaning composition.

23. A cleaning composition prepared by a process comprising combining water, citric acid, an alkali metal hydroxide, one or a plurality of $C_{12}$-$C_{15}$ non-ionic surfactants, and an organophosphate hydrotrope to form a solution having a pH of between about 9.0 and about 10.0.

* * * * *